United States Patent [19]

Harms et al.

[11] 4,121,610

[45] Oct. 24, 1978

[54] ELECTRICALLY OPERATED PROPORTIONAL FLOW CONTROL HYDRAULIC VALVE AND MANUALLY OPERABLE REMOTE CONTROL DEVICE THEREFOR

[75] Inventors: Louis C. Harms, Evanston; Raymond R. O'Toole, Jr., Deerfield, both of Ill.

[73] Assignee: AMBAC Industries Incorporated, Carle Place, N.Y.

[21] Appl. No.: 821,785

[22] Filed: Aug. 4, 1977

Related U.S. Application Data

[63] Continuation of Ser. No. 654,703, Feb. 2, 1976, abandoned.

[51] Int. Cl.[2] ..... F15B 13/02

[52] U.S. Cl. ..... 137/117; 91/448; 137/596.12; 251/30; 251/284

[58] Field of Search ..... 137/117, 501, 596.12; 251/284, 30, 43; 91/448

[56] References Cited

U.S. PATENT DOCUMENTS

| | | | |
|---|---|---|---|
| 2,781,049 | 2/1957 | Binford et al. | 137/117 |
| 2,789,576 | 4/1957 | Mitchell | 137/117 X |
| 3,381,936 | 5/1968 | Allen | 137/117 X |
| 3,434,390 | 3/1969 | Weiss | 137/625.64 X |
| 3,532,104 | 10/1970 | Hoen | 137/117 X |
| 3,596,677 | 8/1971 | Clark et al. | 137/501 |
| 3,628,557 | 12/1971 | Newborough | 137/117 X |
| 3,777,773 | 12/1973 | Tolbert | 137/117 |
| 3,785,392 | 1/1974 | Baker | 137/117 |

*Primary Examiner*—Gerald A. Michalsky

*Attorney, Agent, or Firm*—Charles B. Cannon

[57] ABSTRACT

A proportional fluid flow control hydraulic valve including a valve body in which a by-pass flow passage leads from an inlet port to a by-pass outlet port. A valve chamber is arranged between the inlet port and a regulated flow outlet port and the by-pass outlet port. The by-pass flow passage includes an annular auxiliary flow channel which extends in bypassing relationship around the valve chamber. A valve member movably mounted in the valve chamber has valve ports therein for controlling fluid flow from the inlet port and the auxiliary fluid flow channel past the valve member to the regulated flow passage. In one form, the valve member is normally disposed in balanced hydraulic equilibrium in the valve chamber to prevent fluid flow from the inlet port through the auxiliary fluid flow channel and the valve ports in the valve member into the valve chamber and thence into the regulated flow passage. In another form the valve member is normally disposed in a state of balanced hydraulic equilibrium to establish fluid flow from the auxiliary fluid flow channel through the valve ports in the valve member into the valve chamber and thence into the regulated fluid flow passage. Means are provided, including a manually operable remotely controlled solenoid device, for unbalancing the hydraulic equilibrium of the valve member in the valve chamber to cause movement of the valve member and the valve ports therein into or out of communication with the auxiliary flow channel. A pressure compensating valve is movable in a valve chamber in communication with the by-pass outlet passage and the regulated flow passage, to compensate for pressure and flow fluctuations.

23 Claims, 45 Drawing Figures

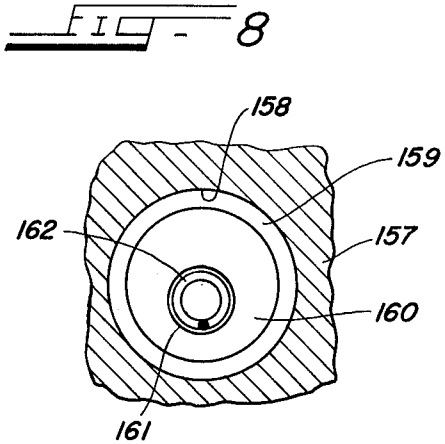
FIG. 8
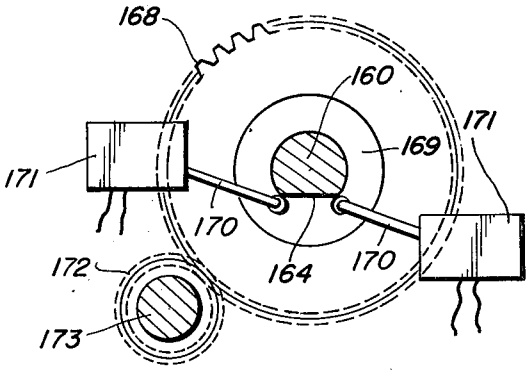
FIG. 9
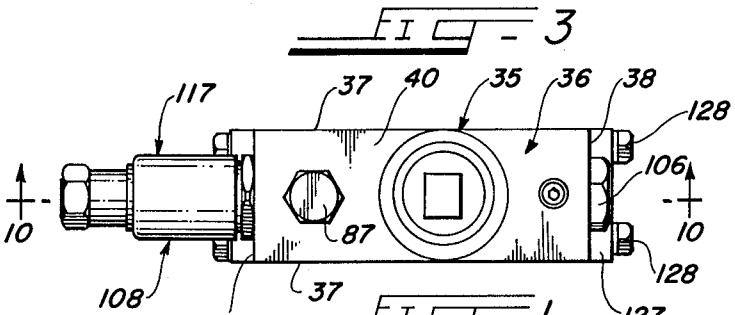
FIG. 3
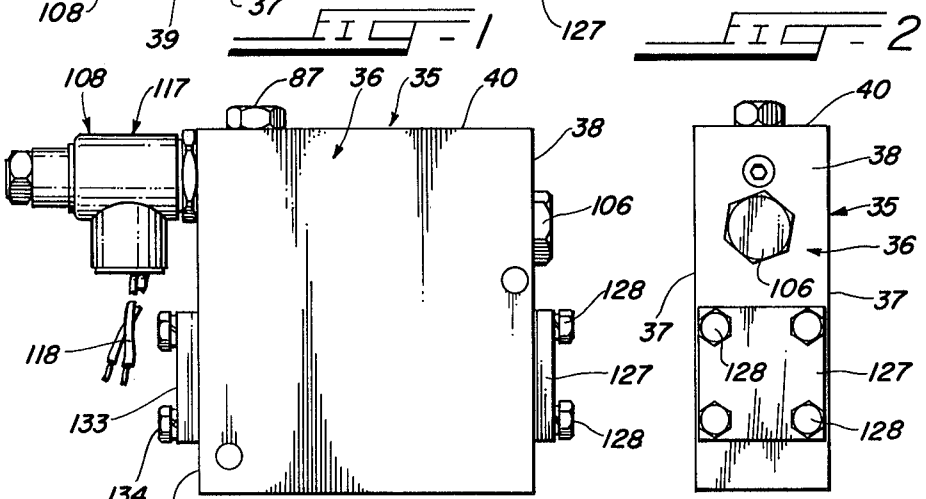
FIG. 2
FIG. 1
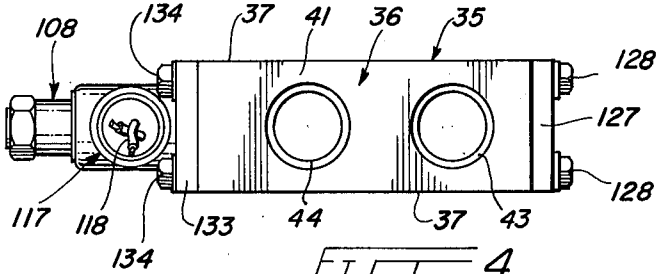
FIG. 4

ELECTRICALLY OPERATED PROPORTIONAL FLOW CONTROL HYDRAULIC VALVE AND MANUALLY OPERABLE REMOTE CONTROL DEVICE THEREFOR

This is a continuation, of application Ser. No. 654,703, filed Feb. 2, 1976, now abandoned.

BACKGROUND OF THE INVENTION

Soleniod-operated hydraulic pilot valves have been known and used heretofore in connection with hydraulic machine tools and other hydraulic machinary and apparatus including servo-mechanisms. However, such prior pilot valves have generally been designed to control the hydraulic pressure of a main valve unit or the opening and closing of a main hydraulic valve and none of such solenoid-controlled pilot valves, or main valve units which they have controlled, as far as we are aware, has met the need and demand for the present invention, namely, for a proportional flow control hydraulic valve in which oil or like hydraulic fluid flows through fluid flow passages provided in the body of the valve under control of a solenoid-operated pilot valve device and in which the solenoid operating means for the pilot valve is arranged in an electrical energizing circuit which is under control of a manually operable remote control device, which may be manually operated at a point remote from the location of the new proportional flow control hydraulic valve in or as a part of a hydraulic circuit, machine, apparatus or system, such, for example, as the boom of a mobile aerial truck, or the like, so that the operator thereof may control the hydraulic operating system for the boom and the speed of movement of the boom over a wide range from slow or so-called "inching" speeds to maximum speed while the operator is located on the operator's platform.

The present invention relates to an electrically operated pressure-compensated proportional flow control hydraulic valve and a manually operable remote control device therefor for use in hydraulic systems such as are used in hydraulic machine tools, mobile aerial truck booms, marine hydraulic systems, lifting cranes, earth-handling and earth-moving equipment and machinery, automotive trucks, salt, sand and fertilizer spraying or spreading devices, meter-in and meter-out and by-pass type flow control hydraulic circuits.

The new proportional flow control valve includes a valve body having therein an inlet port through which oil or like hydraulic fluid may flow from a hydraulic pump or the like when the energizing circuit and the operating solenoid for the new valve are deenergized. The valve body also has formed therein a regulated flow outlet port; a by-pass outlet port; a regulated flow passage leading from the inlet port to the regulated flow outlet port; and a by-pass flow passage leading from the inlet port to the by-pass outlet port. The valve body also has a hydraulic flow control valve chamber formed therein which is disposed between the inlet port and the regulated flow outlet port and the by-pass outlet port and the hydraulic flow control valve chamber is adapted to have communication with the regulated flow passage and with the by-pass flow passage. In a preferred form of the invention, a hydraulic flow control valve member is arranged in the hydraulic flow control valve chamber and embodies a group of hydraulic fluid control valve ports for controlling the flow of hydraulic fluid from the by-pass flow passage through the hydraulic flow control valve chamber to the regulated flow passage, and spring biasing means in the hydraulic flow control valve chamber normally urges the hydraulic flow control valve member into position to close the hydraulic flow control valve ports so that when the operating solenoid for the new valve is deenergized the main body or volume of oil or like hydraulic fluid flowing into the inlet port will flow through the by-pass flow passage to the by-pass outlet port from which it may flow to a reservoir or returned to the hydraulic circuit in which the new valve is incorporated, or otherwise used.

The valve body also has a branched auxiliary or pilot flow passage formed therein and one and a first branch of the auxiliary or pilot flow passage leads from the inlet port into the hydraulic flow control valve chamber and through a central bore or passage in the hydraulic flow control valve member separate and apart from the group of hydraulic flow control valve ports therein and maintains a constant pilot flow such, for example, as 0.15 gpm, at a predetermined pressure, such, for example, as 50 psi, against the hydraulic flow control valve member through the hydraulic flow control valve chamber into the regulated flow passage so as to maintain a predetermined constant hydraulic pressure such, for example, as 50 psi, against the action of the spring biasing means on the hydraulic flow control valve member.

The other and second branch of the auxiliary or pilot flow passage leads from the inlet port to the opposite end of the hydraulic flow control valve chamber, and has a pilot valve seat formed therein, and a pilot valve member is movably mounted in the auxiliary or pilot flow passage for movement toward and into engagement with the pilot valve seat.

The movable pilot valve member is under control of an energizing circuit which includes a solenoid device, including a solenoid plunger, and when the energizing circuit and the solenoid are deenergized the movable pilot valve member is disposed out of engagement with the pilot valve seat so that the oil or like hydraulic fluid will flow from the inlet port through the second branch of the auxiliary or pilot flow passage into the hydraulic flow control valve chamber at the opposite end thereof under a predetermined pressure such, for example, as 50 psi, so as to maintain the hydraulic fluid control valve member in the hydraulic flow control valve chamber in a state of balanced equilibrium and in a position to maintain the group of hydraulic flow control valve ports therein is closed position so that the main body of oil or like hydraulic flow from the fluid inlet port will flow from the inlet port around the hydraulic flow control valve chamber into the by-pass flow passage.

However, when the energizing circuit and the solenoid operating device for the movable pilot valve member are energized the pilot valve member is moved by the solenoid plunger toward or into engagement with the pilot valve seat, thereby reducing the volume of flow of hydraulic fluid through the second branch of the auxiliary or pilot flow passage into the hydraulic fluid control valve chamber with the result that a hydraulic pressure differential is established at opposite ends of the hydraulic fluid control valve member in the hydraulic fluid control valve chamber with the result that the pressure of the biasing spring on the hydraulic fluid control valve member is overcome and the hydraulic pressure of the hydraulic fluid at one end of the hydraulic fluid control valve member moves the hydraulic fluid control valve member into position to open the group of hydraulic fluid control ports and thus direct a proportional volume of the hydraulic fluid from the by-pass flow passage through the group of hydraulic fluid control valve ports into the hydraulic fluid control valve chamber and thence into regulated flow passage and to the regulated flow outlet port.

The invention also includes an electrical energizing circuit for the solenoid-operating device for the movable pilot valve member and a manually operable remote control device including a manually operable remote control lever for controlling the energization of the electrical energizing circuit and the operating solenoid for the pilot valve member so that the movement of the solenoid plunger which operates the movable pilot valve member bears a direct linear relation to the movement of the manually operable remote control lever and resulting energization of the electrical energizing circuit for the solenoid-operating device for the pilot valve with the result that the hydraulic pressure differential in the hydraulic fluid control valve chamber and the resulting linear movement of the hydraulic fluid control valve member therein and the corresponding extent to which the group of hydraulic fluid control valve ports is opened bears a direct linear relation to the extent of movement of the manually operable remote control lever from its normal or at rest position.

The invention further includes pressure-compensating means for compensating the hydraulic pressure in the regulated flow passage and in the by-pass flow passage so as to maintain a constant and uniform hydraulic pressure on the hydraulic fluid control valve member in the hydraulic fluid control valve chamber, and the new valve also embodies a reverse flow check valve unit for controlling the reverse flow of hydraulic fluid from the regulated flow passage outlet port through the regulated flow passage to the inlet port to establish a reverse flow through the regulated flow passage in certain uses of the invention.

In a typical use of the invention, the electrical energizing circuit for the operating solenoid for the movable pilot valve may incorporate one or more solenoid-operated hydraulic proportional flow control valves for use in hydraulic systems in which the invention may be used.

In another form of the invention the hydraulic fluid control valve member in the hydraulic fluid control valve chamber is normally disposed in a position in which the hydraulic fluid control valve ports therein conduct the main body or volume of oil or like hydraulic fluid from the inlet port through the hydraulic fluid control valve ports into the hydraulic fluid control valve chamber and thence into the regulated flow passage and energization of the operating solenoid for the movable pilot member causes the hydraulic fluid control valve member to be moved into position to direct a proportional part of the main body or volume from the inlet port into the by-pass flow passage and thence into the by-pass outlet port.

OBJECTS OF THE INVENTION

An object of the invention is to provide a new and improved electrical operated pressure-compensated proportional flow control hydraulic valve and a manually operable remote control device therefor for use in hydraulic systems such as are used in hydraulic machine tools, mobile aerial truck booms, marine hydraulic systems, lifting cranes, earth-handling and earth-moving equipment and machinery, automotive truck salt, sand and fertilizer spraying and spreading devices, meter-in, meter-out and by-pass flow control hydraulic circuits, and the like, and in the use of which the operator is able to control the flow of hydraulic fluid through the hydraulic system by operation of a manually operable remote control device from a slow or so-called "inching" speed and "feathering" operation to a maximum speed and thus exercise rapid and precise control over the operating equipment from a point remote from the location of the new proportional flow control hydraulic valve in the hydraulic system.

Another object of the invention is to provide a new and improved proportional flow control hydraulic valve and remote control device therefor, in the use of which the body or volume of oil or like hydraulic fluid flowing therethrough may be precisely determined by manual movement and setting of the manually operable remote control device and will remain constant and uniform in direct linear relation to the extent of the manual movement of the manually operable remote control device from its normal or neutral position even though the body or volume of oil or like hydraulic fluid flowing into the new proportional flow control hydraulic valve through the inlet port therein may vary due to variations in the hydraulic pump flow or for other reasons.

An additional object of the invention is to provide a new and improved proportional flow control hydraulic valve which includes a valve body having a fluid inlet port, a regulated flow outlet port, and a by-pass outlet port, a novel regulated flow passage from the inlet port to the regulated flow outlet port, a novel by-pass flow passage from the inlet port to the by-pass outlet port, and through which, in a preferred form of the invention, the main body or volume of oil or like hydraulic fluid flows when the manually operable remote control device is in its neutral position, and a novel arrangement of a hydraulic flow control valve chamber, a hydraulic flow control valve member therein having a group of hydraulic flow control valve ports formed therein for controlling the flow of a proportional part of the main body or volume or oil or like hydraulic fluid which will flow from the by-pass flow passage through the hydraulic flow control valve chamber and into the regulated flow passage when the movably operable remote control device is operated to energize the energizing circuit for the movable pilot valve member with the said proportional flow bearing a direct linear relation to the degree or arc of movement of the manually operable remote control device.

A further object of the invention is to provide in the body of the new proportional flow control hydraulic valve a novel branched auxiliary or pilot flow passage between the inlet port and the hydraulic fluid control valve chamber for maintaining a pilot flow of oil or like hydraulic fluid flow into the hydraulic fluid control valve chamber at opposite ends of the hydraulic fluid control valve member therein so as to maintain a state of balanced hydraulic pressure equilibrium in the hydraulic fluid control valve chamber and against the hydraulic fluid control valve member therein and thereby maintain the hydraulic fluid control valve member in a static or balanced condition in which it maintains the group of hydraulic fluid control valve ports formed therein in a closed position and prevents the flow of oil or like hydraulic fluid from the main inlet port and the by-pass flow passage through the valve chamber to the regulated flow passage.

Another object of the present invention is to provide in the invention a novel combination of elements and parts which includes in one branch of the auxiliary or pilot flow passage a novel pilot valve unit which includes a pilot valve seat and a movable pilot valve member for controlling the volume or body of the flow of the oil or like hydraulic fluid which will flow through the auxiliary or pilot flow passage into the hydraulic fluid control valve chamber at one end of the hydraulic fluid control valve therein, together with a novel energizing circuit having embodied therein an operating solenoid for moving the movable pilot valve member toward and away from the pilot valve seat; and a novel manually operable remote control device for controlling the energization of the electrical energizing circuit and the operating solenoid for the movable pilot valve member embodied therein so that the manually operable remote control device may be manually moved into a position to establish a predetermined energization of the electrical energizing circuit and the operating solenoid for the movable pilot valve member and thereby move the movable pilot valve member toward and into engagement with the pilot valve seat and thus control the volume of hydraulic fluid flow through the pilot valve passage into the hydraulic fluid control valve chamber and thereby correspondingly unbalance the static or balanced hydraulic pressure condition on the hydraulic fluid control valve member in the hydraulic fluid contol valve chamber and thus cause the hydraulic fluid control valve member to move the group of hydraulic fluid control valve ports formed therein into communication with the by-pass passage and thereby cause a proportional part of oil or like hydraulic fluid to flow from the by-pass flow passage through the group of hydraulic fluid control valve ports therein into the hydraulic fluid control valve chamber and thence into the regulated flow passage in direct linear relation to the degree or arc of movement of the manually operable remote control device for the electrical energizing circuit and the operating solenoid for the movable pilot valve member.

Another object of the invention is to enable the electrical energizing circuit for the operating solenoid for the movable pilot valve member and the manually operable remote control device for the electrical energizing circuit embodied in the invention to be used in conjunction with and for control of one or more directional flow control hydraulic valves and other hydraulic circuit devices which may be embodied in hydraulic systems and circuits in which the present invention may be used.

A further object of the invention is to provide in the new proportional flow control hydraulic valve a novel fluid pressure compensating valve chamber and a pressure compensating valve unit for maintaining a constant pressure differential in the hydraulic fluid control valve chamber.

Still another object of the invention is to provide therein a novel combination of elements which includes a novel arrangement of spring biasing means in the hydraulic fluid control valve chamber for normally biasing the hydraulic fluid control valve member therein into a position to maintain the group of hydraulic fluid control valve ports therein in closed position against the normally balanced forces of the hydraulic fluid pressures in the hydraulic fluid control valve chamber and against the hydraulic fluid control valve member at opposite ends thereof, together with an auxiliary or pilot flow passage which acts to reduce the hydraulic fluid pressure in the hydraulic fluid control valve chamber at one end of the hydraulic fluid control valve member when the operating solenoid for the movable pilot valve member is actuated in accordance with the manual setting of the manually operable remote control device to move the movable pilot valve member toward or into engagement with the pilot valve seat and thus reduce the flow of hydraulic fluid from the inlet port through the auxiliary or pilot flow passage into the hydraulic fluid control valve chamber at one end of the hydraulic fluid control valve member and thus enable the hydraulic fluid pressure in the hydraulic fluid control valve chamber at the opposite end of the hydraulic fluid control valve member therein to overcome the force of the spring biasing means and thereby move the hydraulic fluid control valve member into position to move the group of hydraulic fluid control valve ports therein into position to establish fluid flow from the by-pass flow passage through the group of hydraulic fluid control valve ports into the hydraulic fluid control valve chamber and thence into the regulated flow passage.

An additional object of the invention is to enable the new proportional flow control hydraulic valve to be used, under certain operating conditions, as a two-port flow regulator device by closing or plugging the by-pass outlet port therein.

Still another object of the invention is to provide in one form thereof a novel construction in which the group of hydraulic fluid control valve ports in the hydraulic fluid control valve member are normally disposed to conduct the main body or volume of oil or like hydraulic fluid from the inlet port through the hydraulic fluid control valve chamber and thence into the regulated flow passage but in which the hydraulic fluid control valve member may be moved by operation of the normally operable remote control device and resultant energization of the energizing circuit for the operating solenoid for the movable pilot valve member into communication with the by-pass flow passage to divert a proportional part of the main body or volume of oil or like hydraulic fluid from the inlet port through the group of hydraulic fluid control valve ports into the by-pass flow passage.

Other objects will appear hereinafter.

DESCRIPTION OF FIGURES IN THE DRAWINGS

FIG. 1 is a side elevational view of the new proportional flow control hydraulic valve and of the operating solenoid for the movable pilot valve member which are embodied in the invention;

FIG. 2 is an end elevational view of the device as seen from the right hand end in FIG. 1;

FIG. 3 is a top plan view of the device shown in FIGS. 1 and 2;

FIG. 4 is a bottom plan view of the device shown in FIGS. 1 to 3, inclusive;

Figure 6:
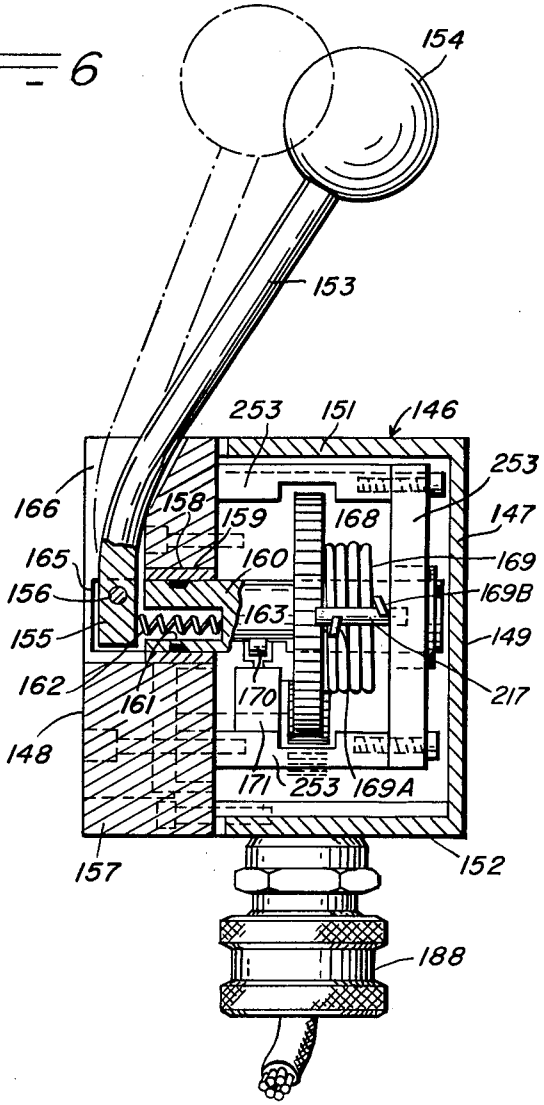
FIG. 6 is a sectional view of the manually operable remote control device showing the manually operable remote control lever in full lines in its neutral or centered and latched position and showing it in dotted lines moved into an unlatched and operative position.
Figure 7:
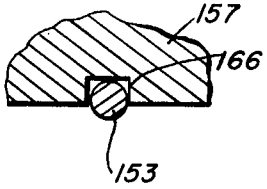
Figure 5:
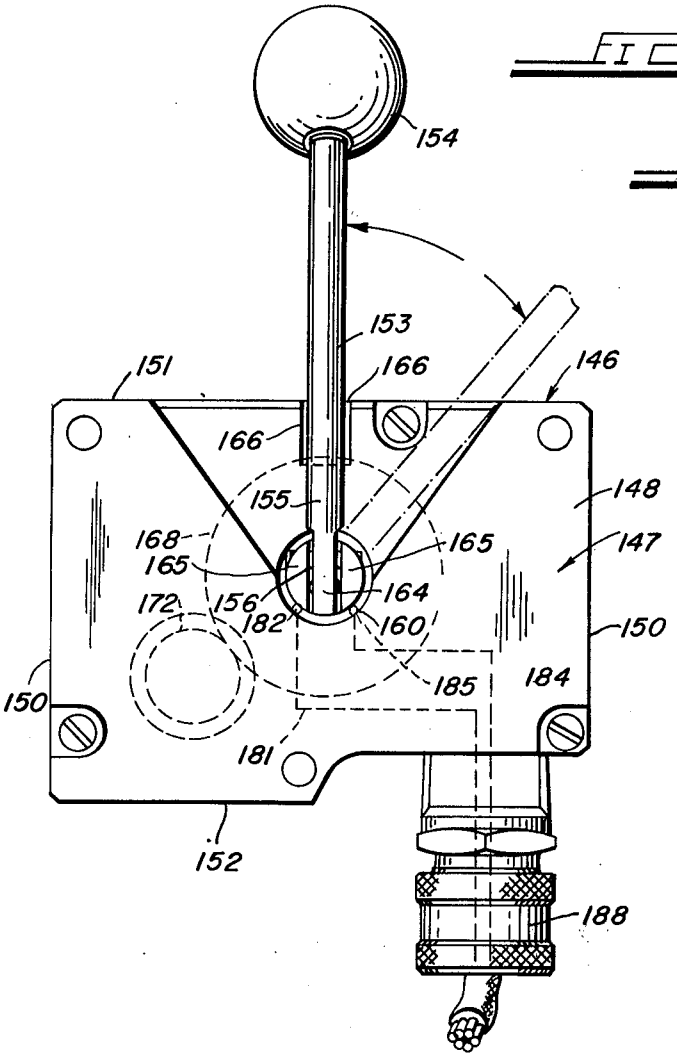
FIG. 5 is a front elevational view of the manually operable remote control device and the manually operable remote control lever embodied therein for controlling the operation of the energizing circuit for the operating solenoid for the movable pilot valve member embodied in the invention, and showing the manually operable remote control lever, in full lines, in its neutral and latched position.
Figure 6A:
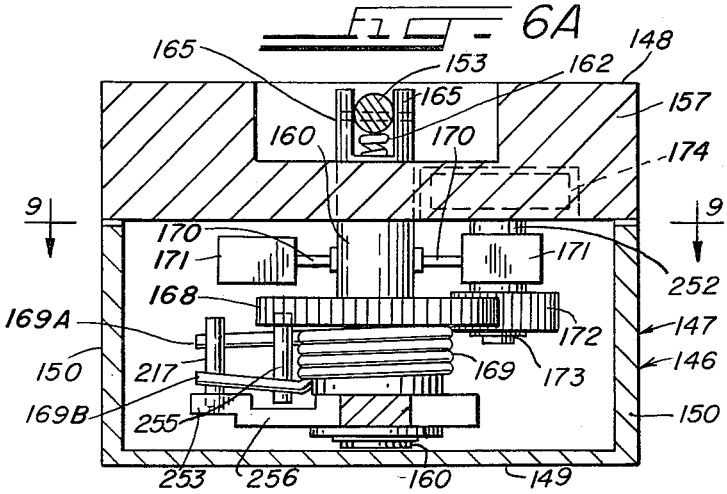
FIG. 6A is a sectional plan view, on line 6A—6A in FIG. 6B, of the manually operable remote control device shown in FIGS. 5, 6, 6B, 6C, 6D, 6E, 7, 8 and 9 of the drawings.
Figure 6B:
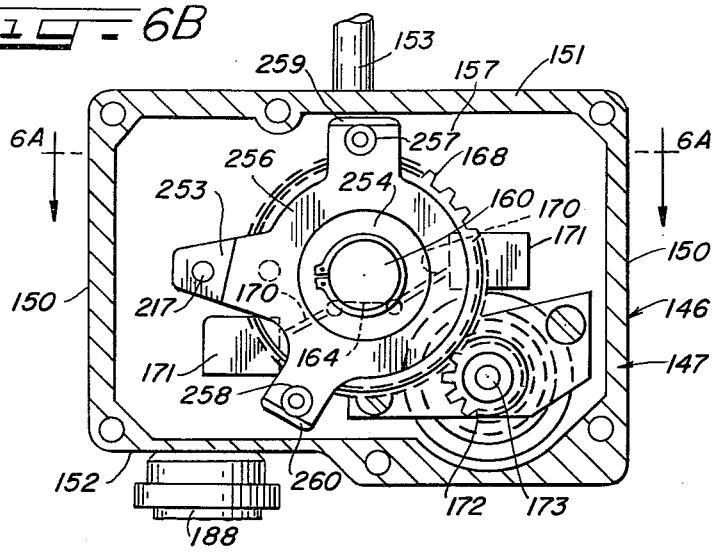
FIG. 6B is a detail view, partly in section and partly in elevation, of parts of the remote control device for the energizing circuit for the operating solenoid for the movable pilot valve member.
Figure 6C:
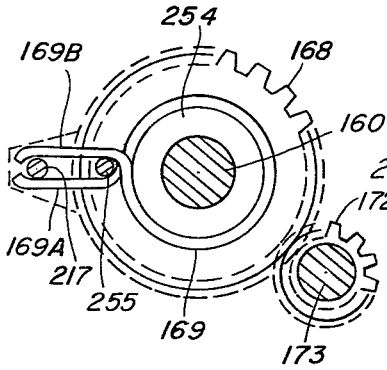
Figure 6D:
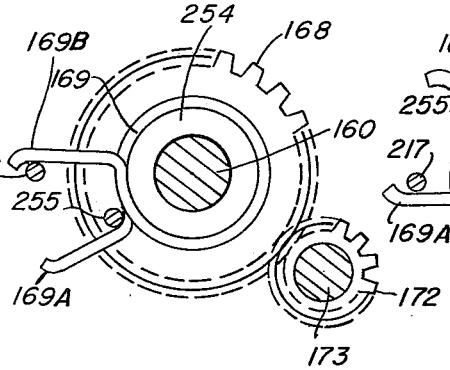
Figure 6E:
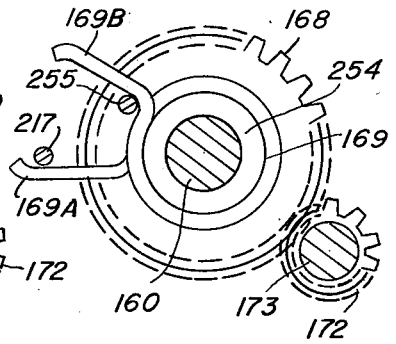
Figure 10:
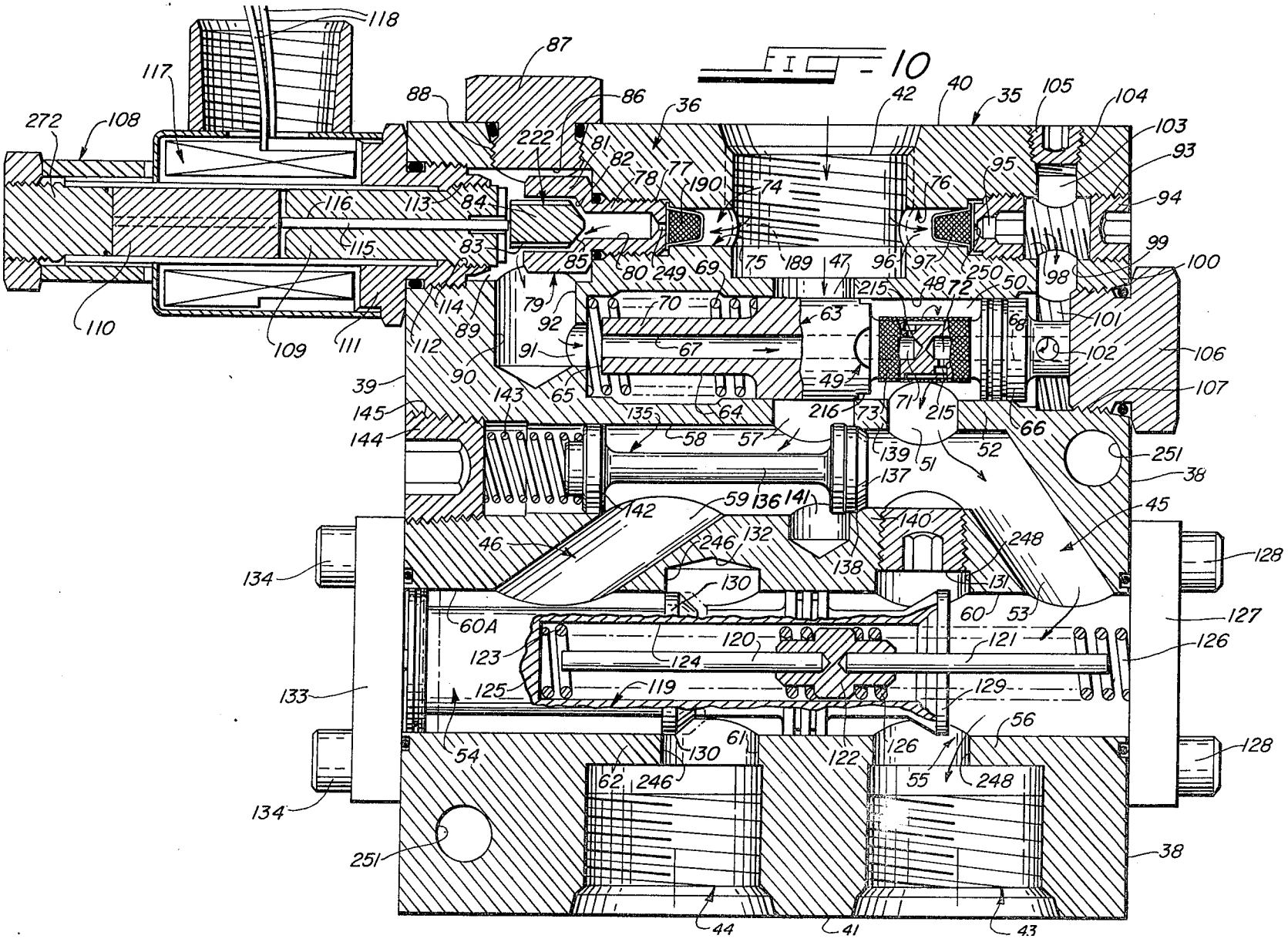
Figure 11:
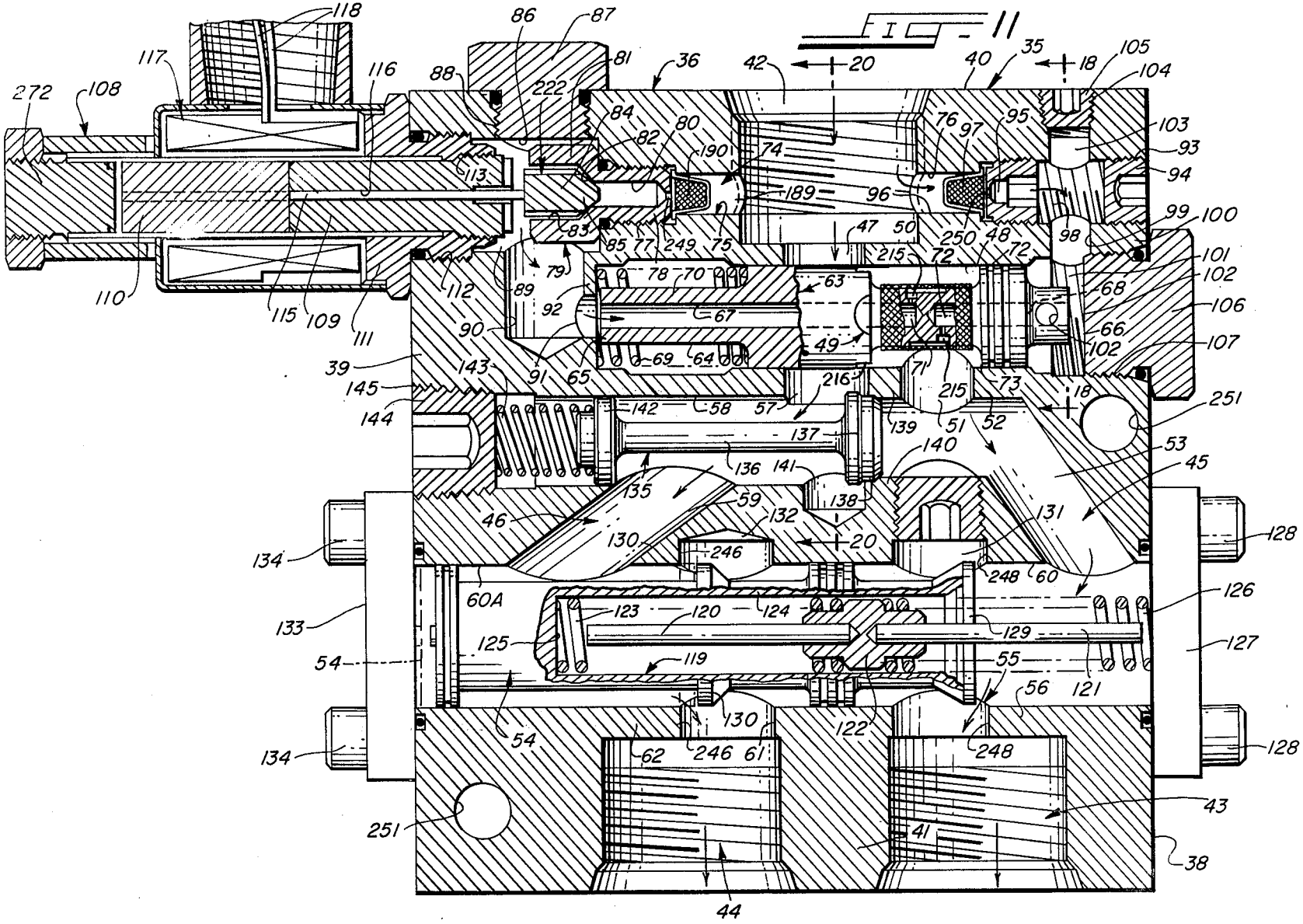
Figure 12:
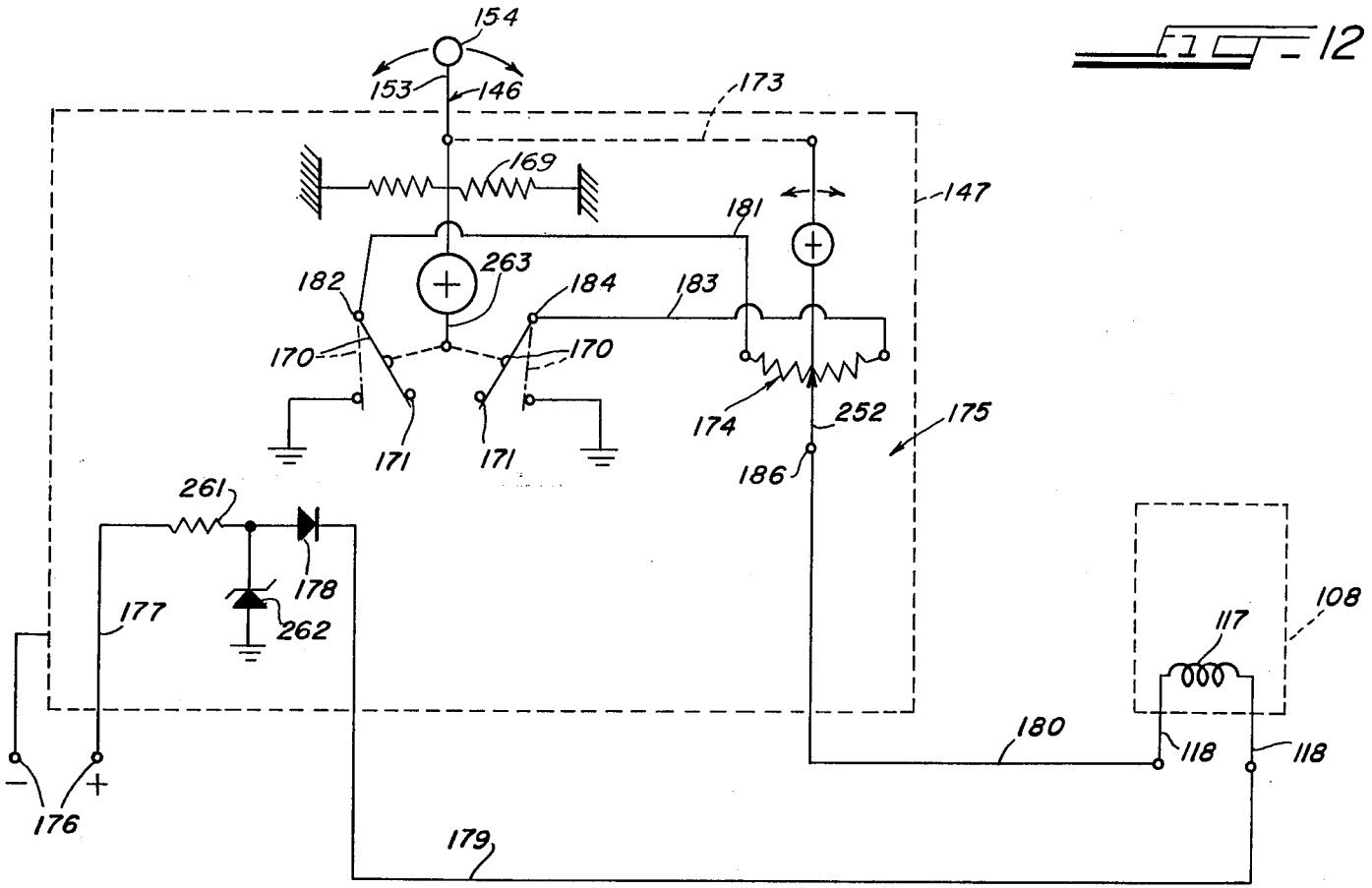
Figure 13:
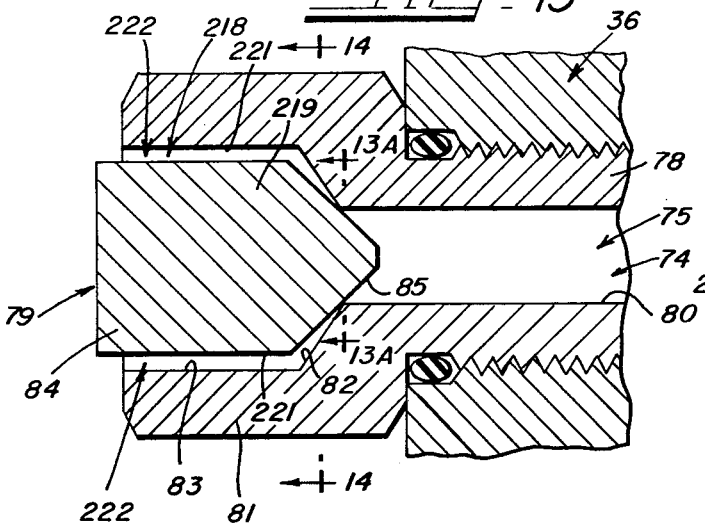

FIG. 6C is a view partly in section and partly in elevation of the resetting and centering spring means for the manually operable remote control lever and for operating the switch-operating arms of the microswitches and showing the position of the resetting and centering spring means when the manually operable remote control lever is in its neutral centered and latched position, and with the switch-operating arms for the microswitches in their normal spring-urged open circuit position;

FIG. 6D is a view similar to FIG. 6C but showing the supporting shaft for the manually operable remote control lever and the sprocket gear thereon moved in one direction from their normal neutral, centered and latched position, as in FIG. 6C, to move the switch-operating arms for one of the microswitches into closed circuit position;

FIG. 6E is a view similar to FIGS. 6C and 6D but showing the supporting shaft for the manually operable remote control lever and the sprocket gear thereon moved in the opposite direction to move the switch-operating arm for the other microswitch into closed circuit position;

FIG. 7 is a sectional detail view illustrating the latching means for the manually operable remote control lever shown in FIGS. 5 and 6;

FIG. 8 is an enlarged sectional view illustrating the mounting means for the manually operable remote control lever shown in FIGS. 5, 6 and 7;

FIG. 9 is a sectional plan view on line 9—9 in FIG. 6A, illustrating the microswitches and the switch-operating arms for the microswitches and the operating means for the switch-operating arms and for the resistor or potentiometer which are embodied in the electrical energizing circuit for the operating solenoid for the movable valve member which is embodied in the invention;

FIG. 10 is an enlarged central sectional view on line 10—10 in FIG. 3 through the body of the new proportional flow control hydraulic valve showing the movable parts thereof in the positions which they occupy when the energizing circuit and the operating solenoid for the movable pilot valve member are in a deenergized condition;

FIG. 11 is an enlarged central sectional view through the body of the new proportional flow control hydraulic valve, similar to FIG. 10, but showing the movable parts illustrated in FIG. 10 in the positions which they occupy when the energizing circuit and the operating solenoid for the movable pilot valve member are in an energized condition;

FIG. 12 is a diagrammatic view illustrating the energizing circuit for the operating solenoid for the movable pilot valve member and the manually operable remote control device for the energizing circuit;

FIG. 13 is an enlarged fragmentary sectional detail view of the movable pilot valve member and the pilot valve seat which are embodied in the invention.

Figure 14:
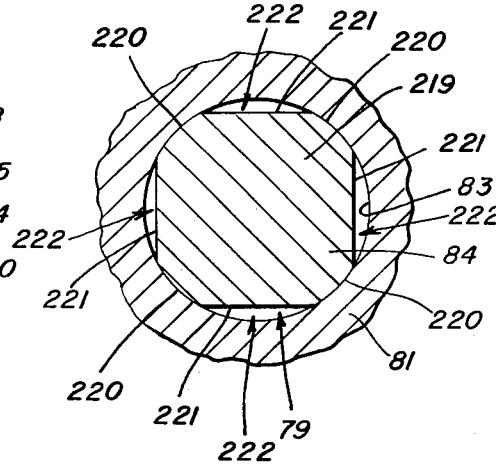
Figure 15:
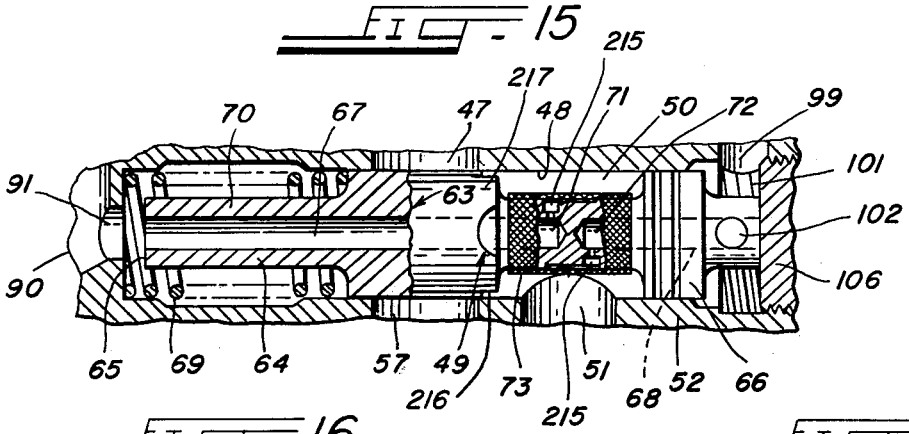
Figure 16:
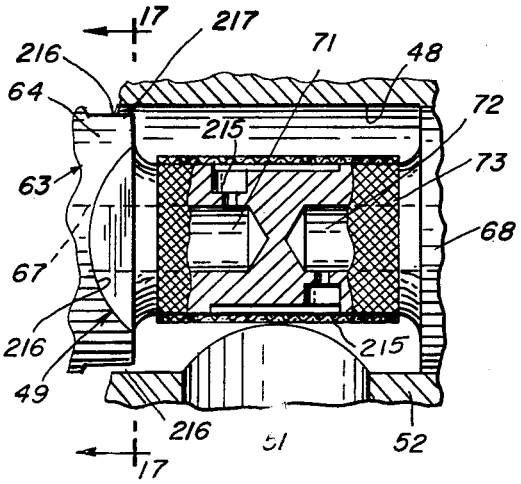
Figure 13A:
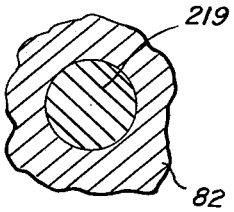
Figure 18:
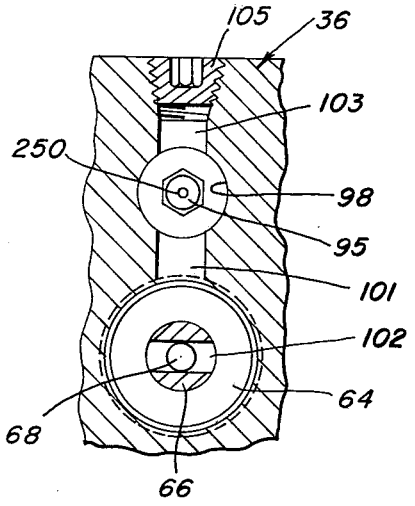
Figure 19:
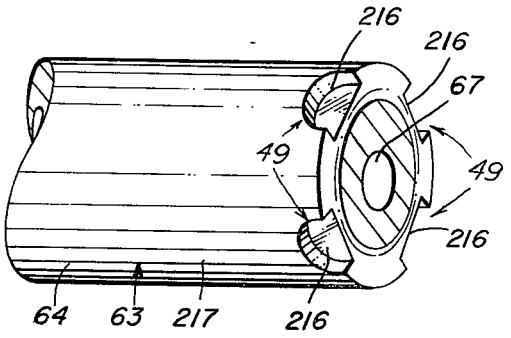
Figure 20:
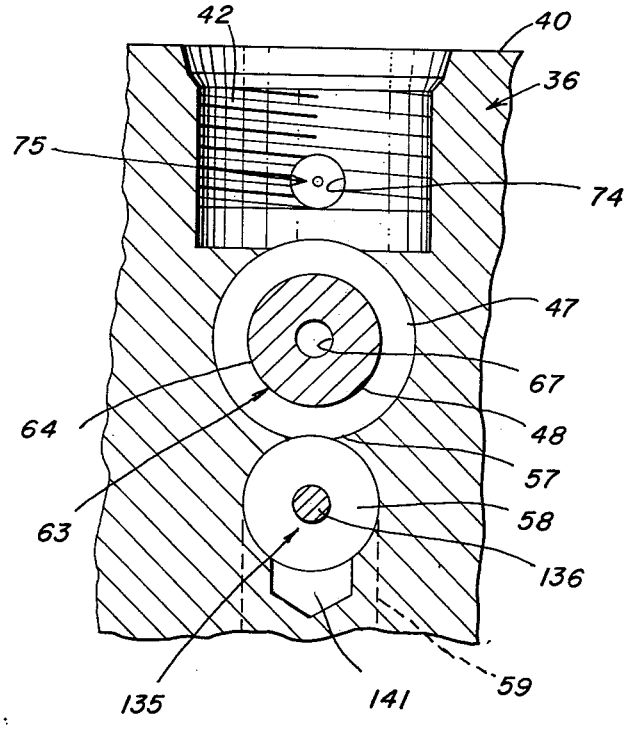
Figure 17:
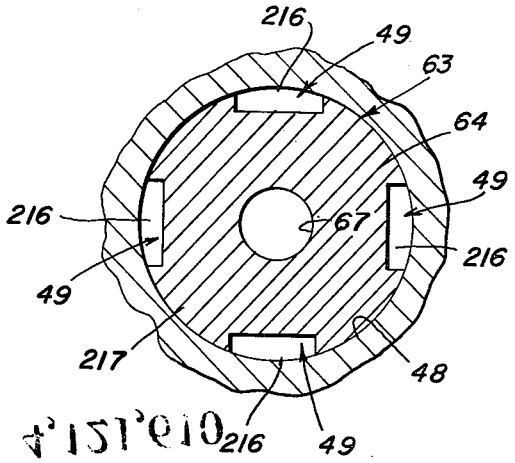
Figure 21:
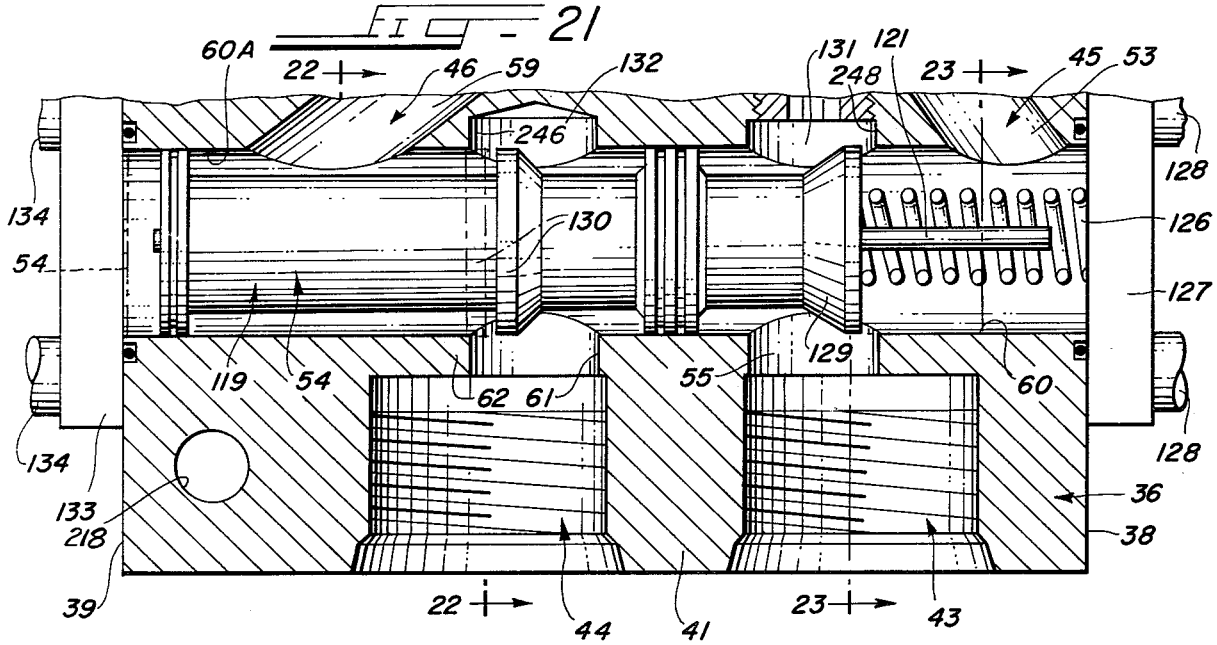
Figure 22:
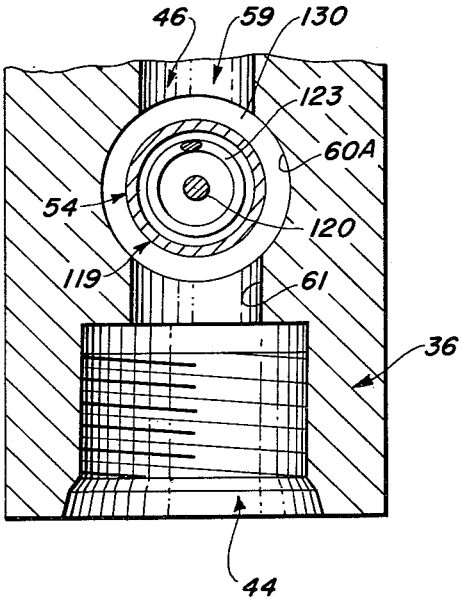
Figure 23:
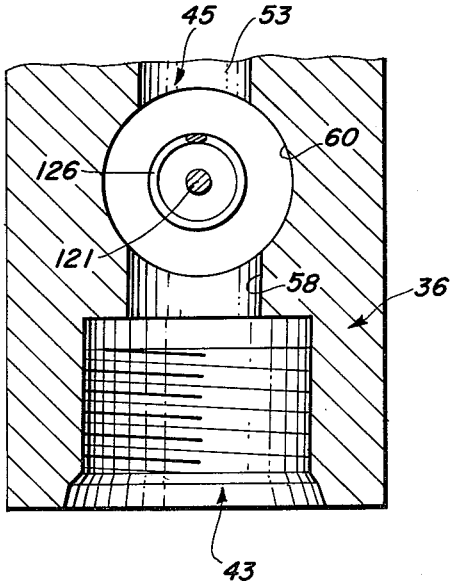
Figure 24:
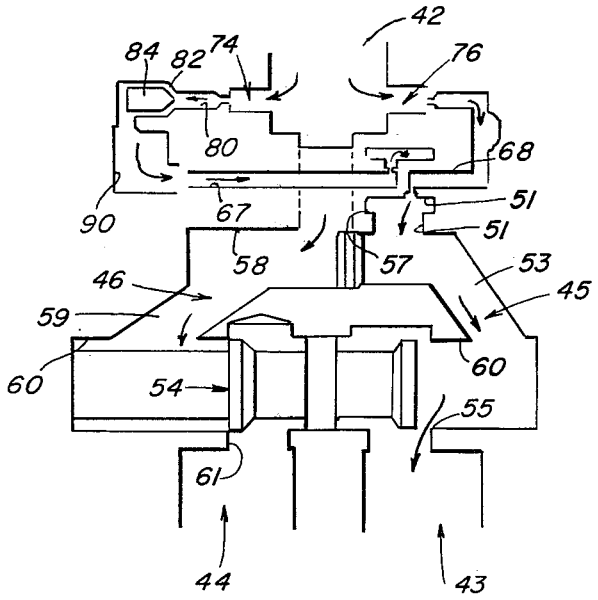
Figure 26:
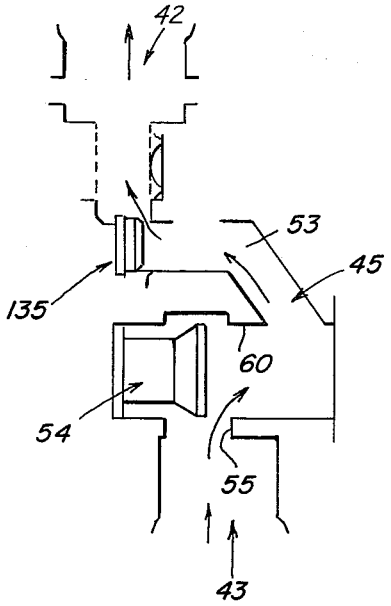
Figure 25:
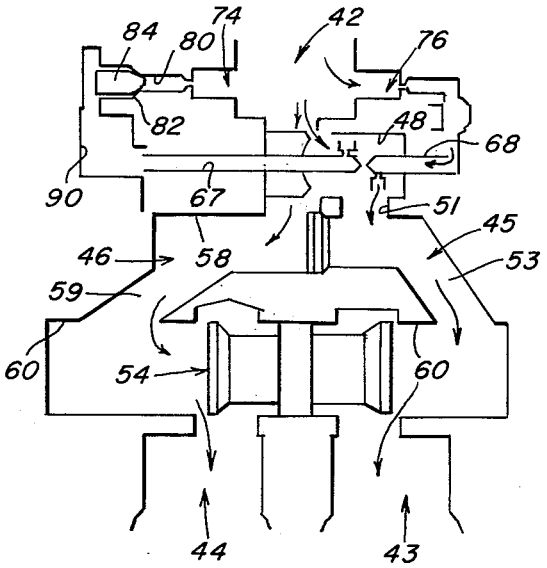
Figure 27:
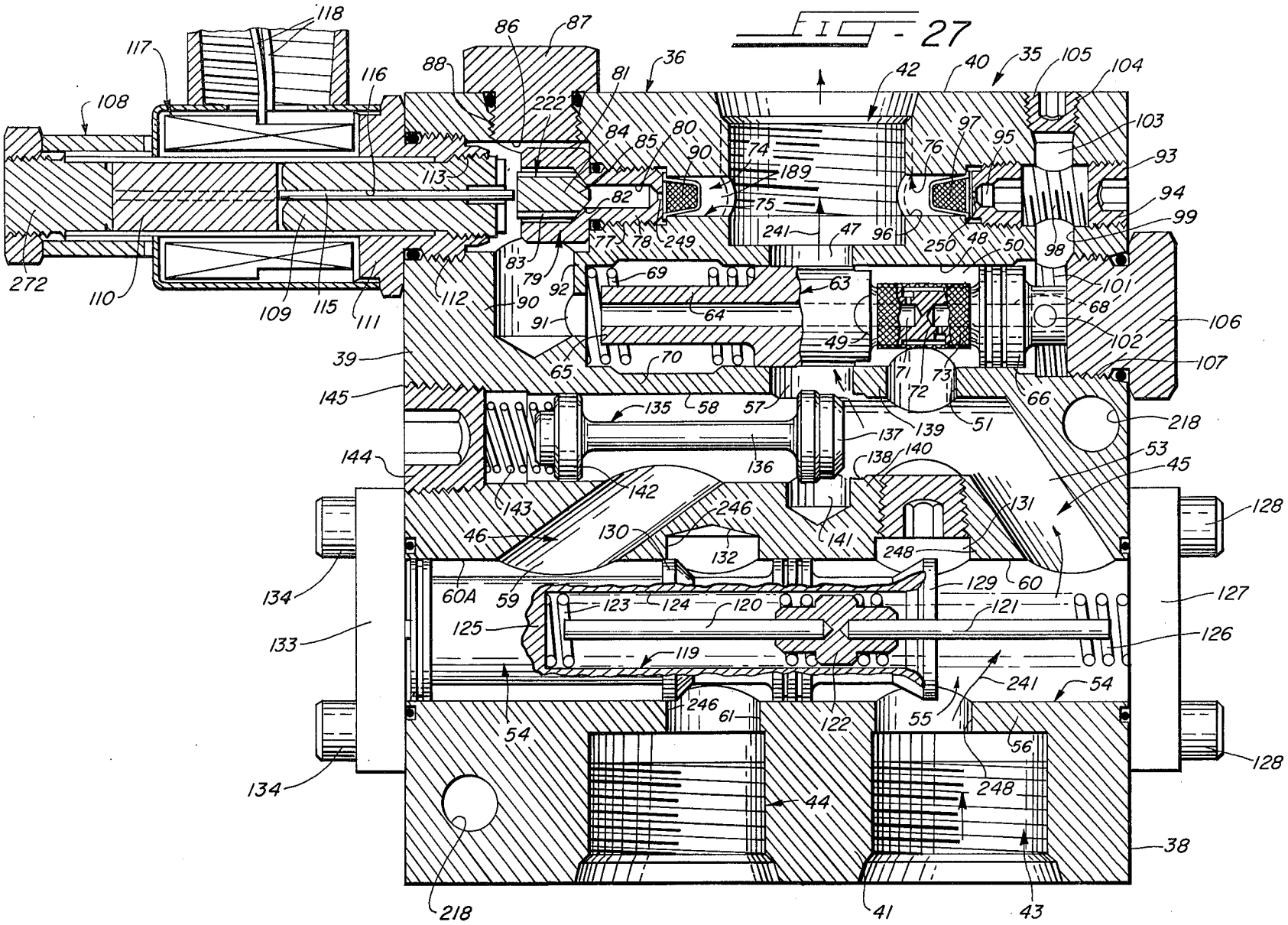
Figure 28:
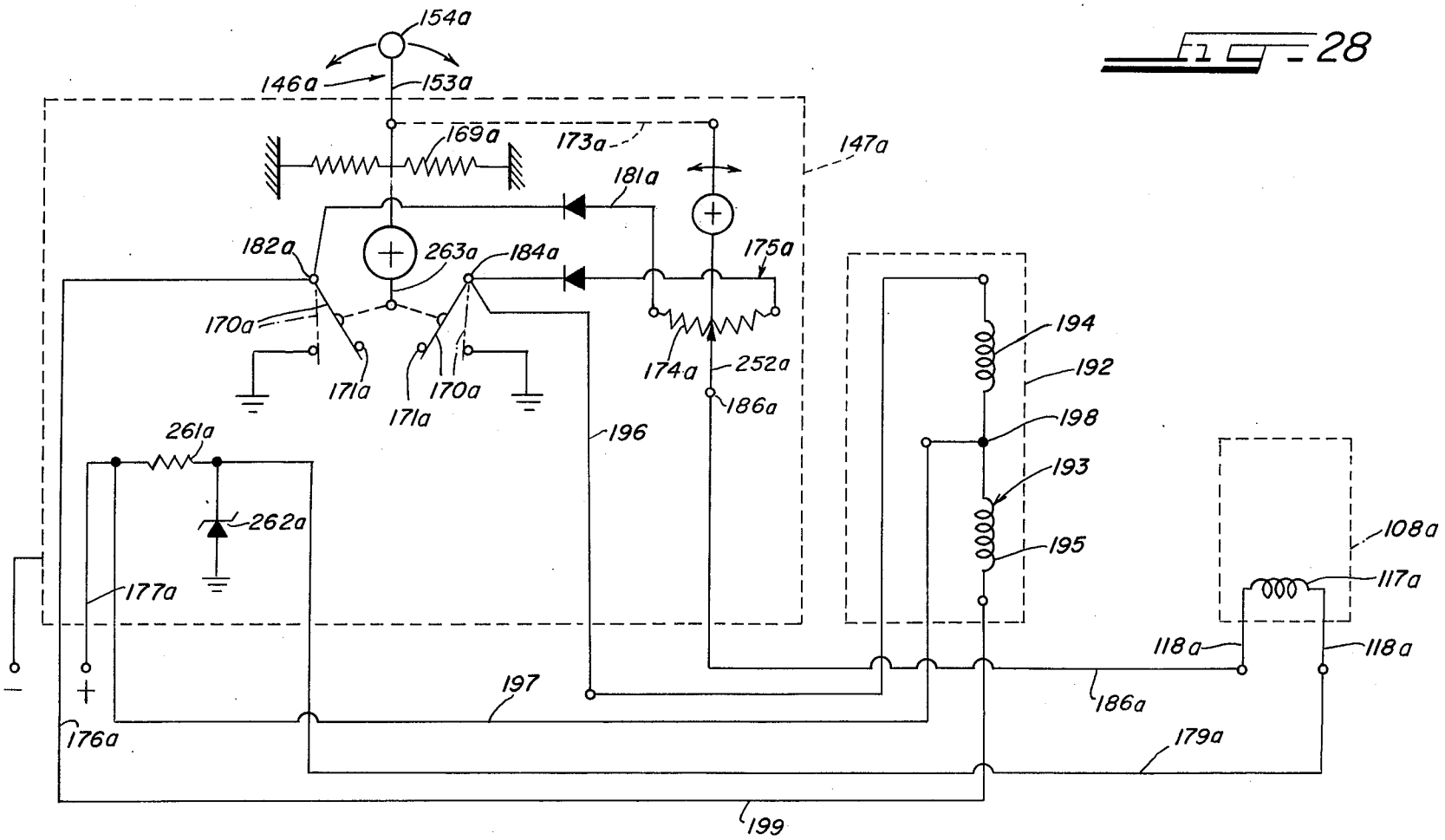
Figure 29:
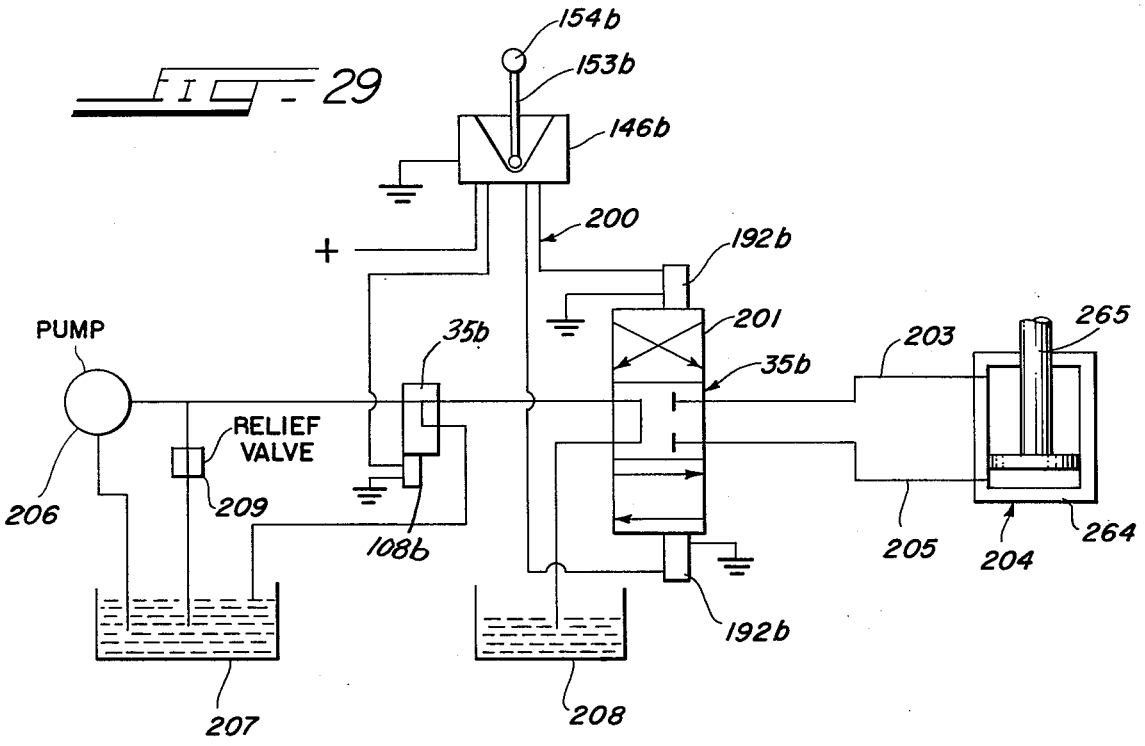
Figure 30:
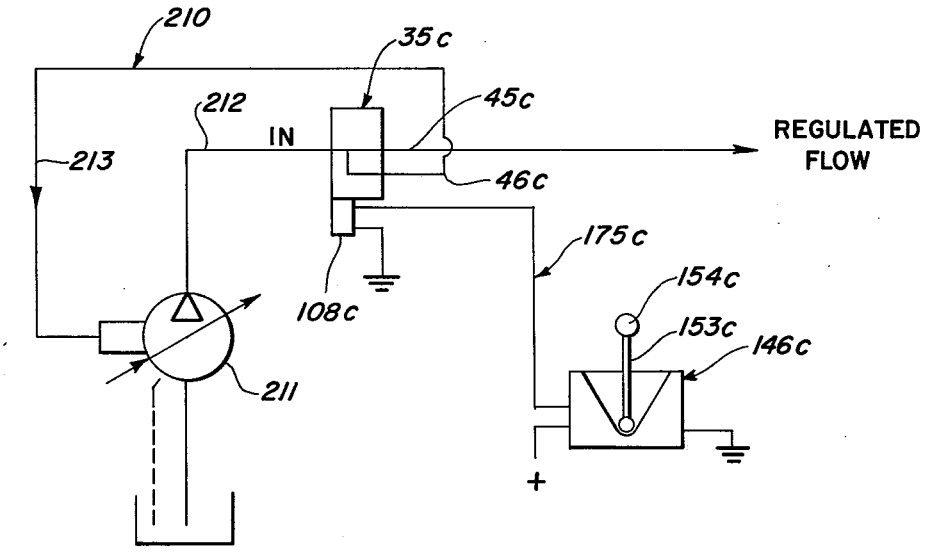
Figure 31:
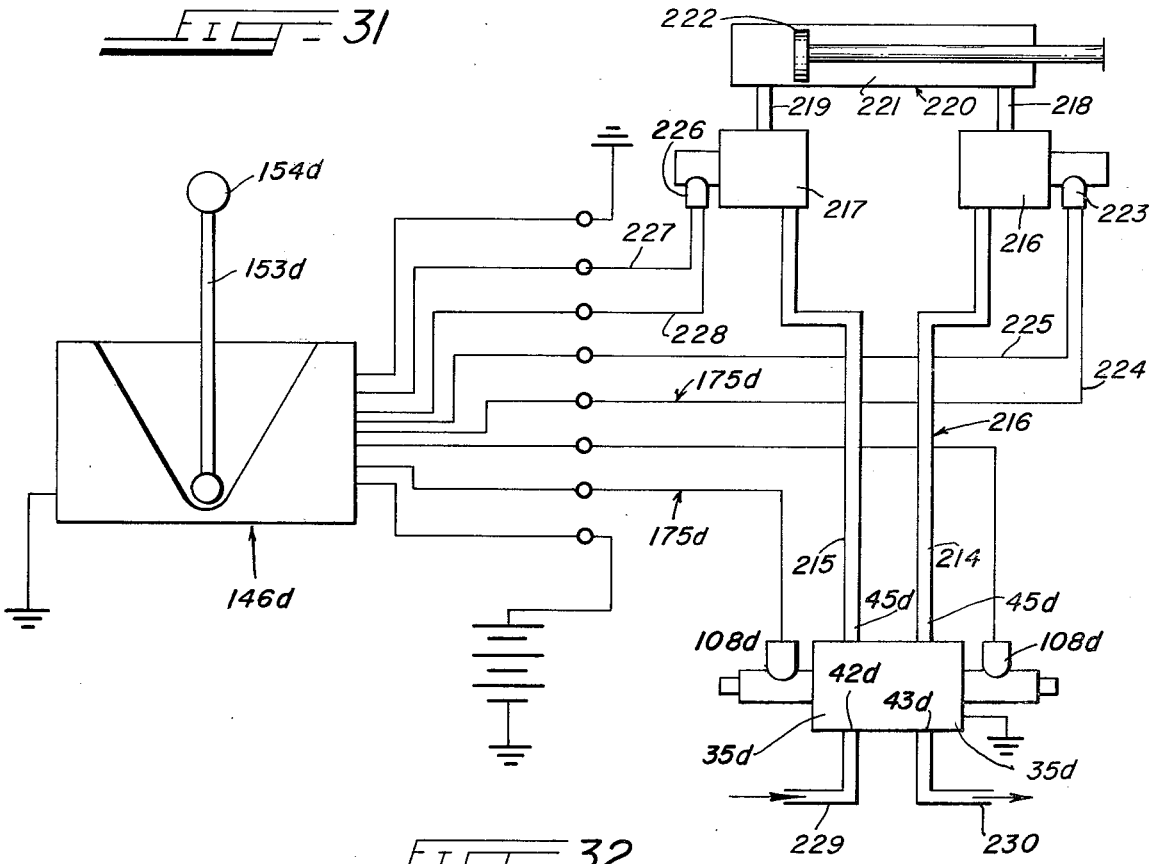
Figure 32:
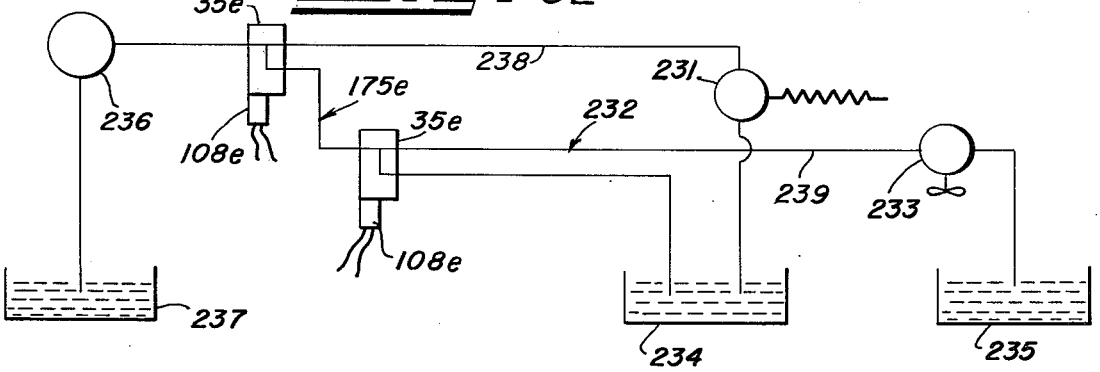
Figure 33:
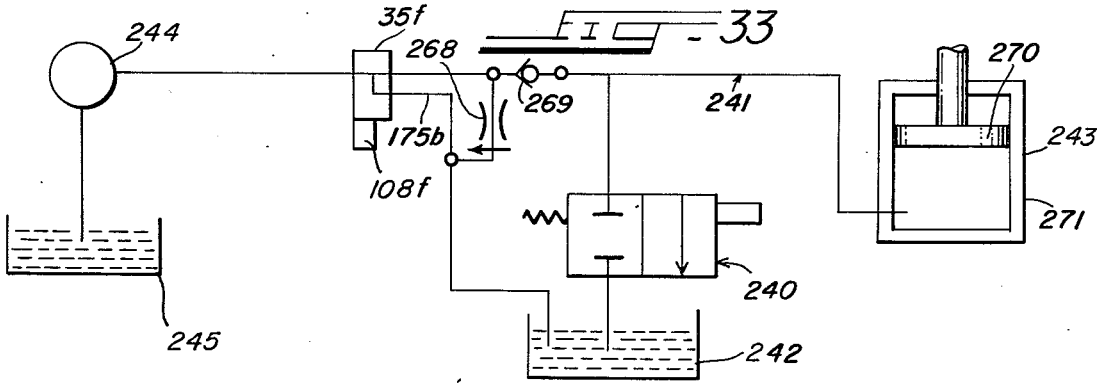
Figure 34:
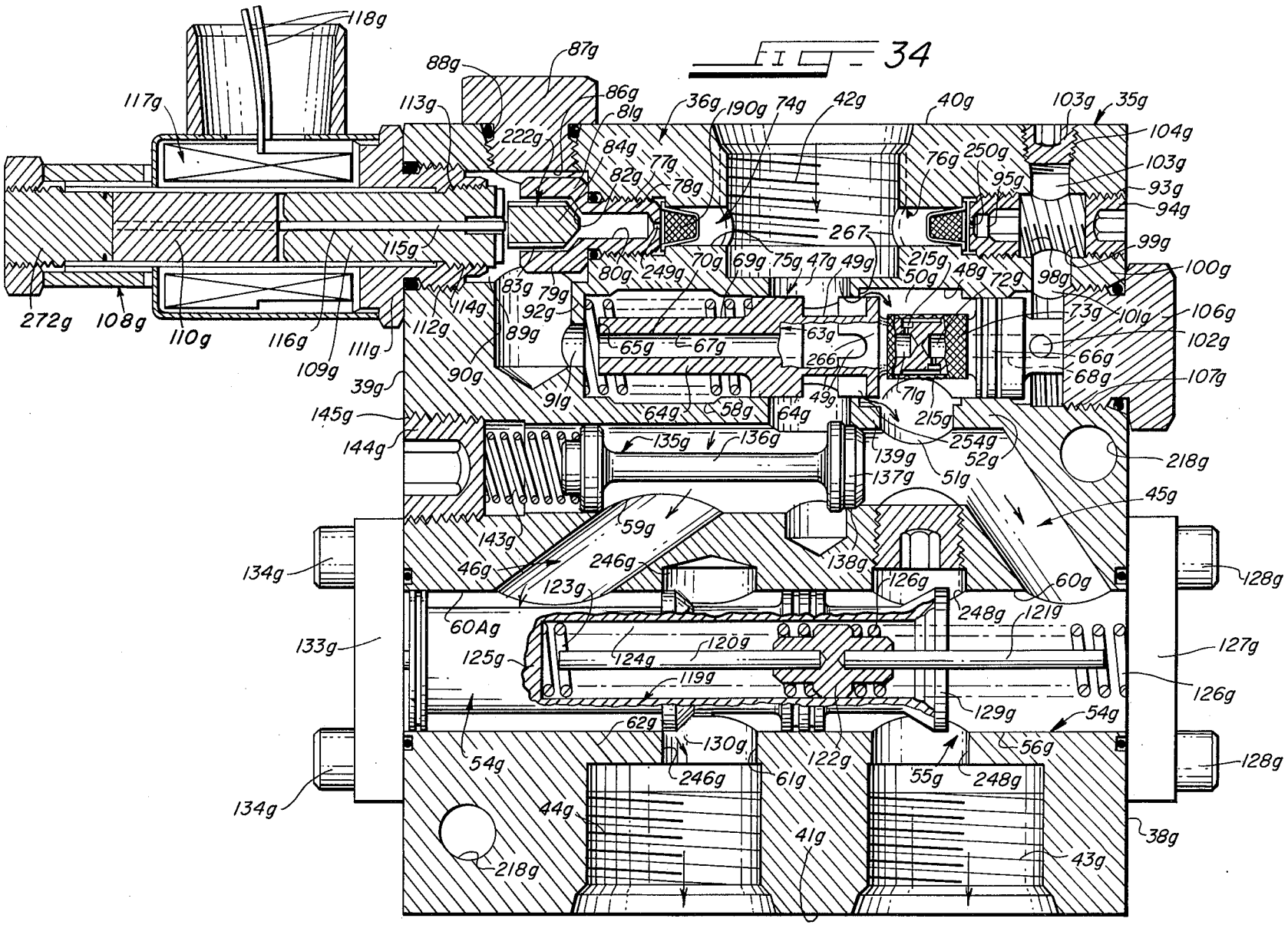
Figures 35, 36:
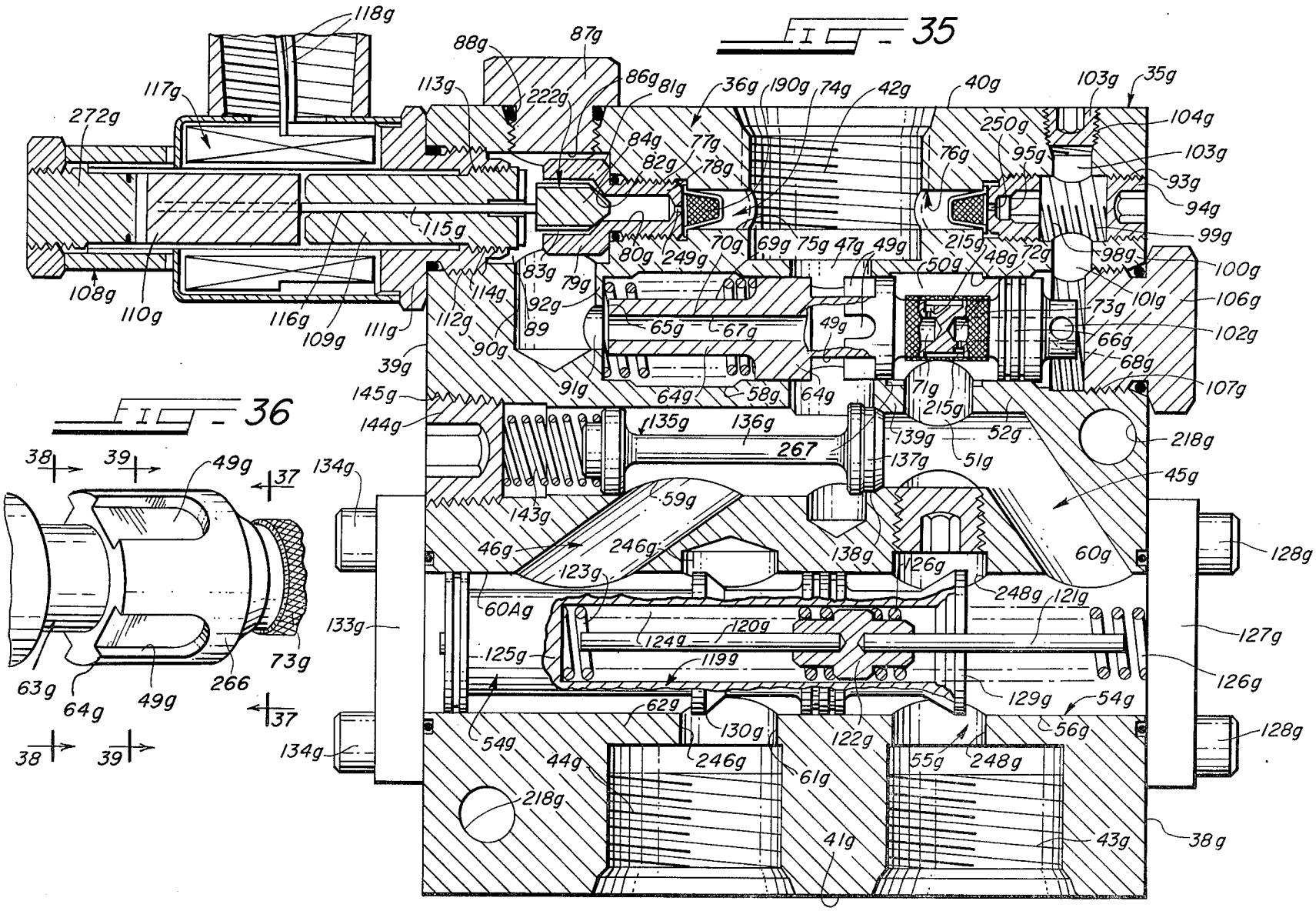
Figure 37:
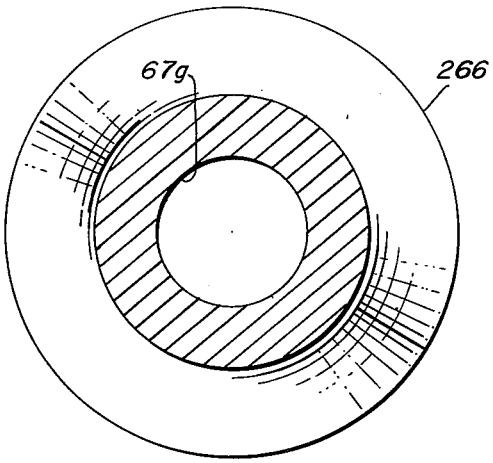
Figure 38:
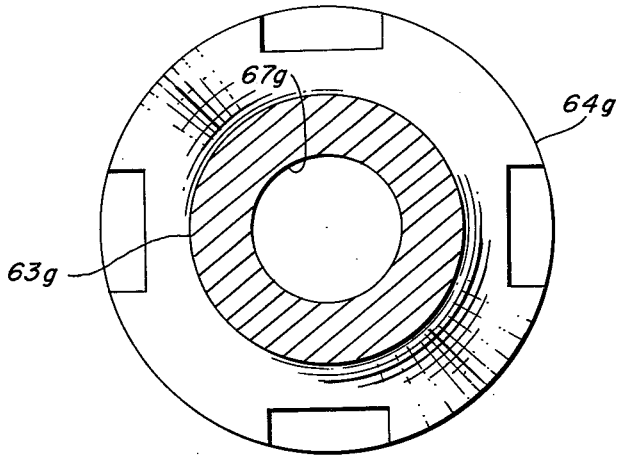

FIG. 13A is an enlarged sectional view on line 13A—13A in FIG. 13 illustrating the pilot valve seat and the movable pilot valve member;

FIG. 14 is a transverse sectional view of the movable pilot valve member and of the pilot valve seat on line 14—14 in FIG. 13;

FIG. 15 is an enlarged longitudinal central sectional view of the hydraulic fluid control valve unit which is embodied in a preferred form of the invention;

FIG. 16 is an enlarged fragmentary sectional view illustrating parts of the hydraulic fluid control valve unit and of the group of hydraulic fluid control valve ports illustrated in FIG. 15;

FIG. 17 is a transverse sectional view on line 17—17 in FIG. 16, illustrating parts of the hydraulic fluid control valve unit shown in FIG. 16 and the group of hydraulic fluid control valve ports embodied therein;

FIG. 18 is an enlarged sectional detail view on line 18—18 in FIG. 11 illustrating parts of one (the second) branch of the auxiliary or pilot flow passage;

FIG. 19 is a fragmentary perspective view of the body of the hydraulic fluid control valve member which is embodied in a preferred form of the invention and illustrating the crescent-shaped valve ports formed in one end portion thereof;

FIG. 20 is an enlarged sectional detail view on line 20—20 in FIG. 11 illustrating the inlet port, part of one (the first) branch of the auxiliary or pilot flow passage, part of the by-pass flow passage, part of the hydraulic fluid control valve unit, and part of the check valve unit which are embodied in the invention;

FIG. 21 is an enlarged central longitudinal sectional view of the pressure-compensating valve unit which is embodied in the invention;

FIG. 22 is a transverse sectional view on line 22—22 in FIG. 21;

FIG. 23 is a transverse sectional view on line 23—23 in FIG. 21;

FIG. 24 is a diagrammatic view illustrating the flow of oil or like hydraulic fluid through the new proportional flow control hydraulic valve unit when the energizing circuit and the operating solenoid for the movable pilot valve member are in deenergized condition and the inlet flow volume not exceeding the bleed flow as, for example, 0.3 gpm;

FIG. 25 is a diagrammatic view comparable to FIG. 24 but showing the flow of oil or like hydraulic fluid through the new proportional flow control valve unit when the energizing circuit and the operating solenoid for the movable pilot valve member are in energized condition;

FIG. 26 is a diagrammatic view illustrating the reverse flow of oil or like hydraulic fluid through the regulated flow passage in the invention, as in certain uses of the invention in hydraulic circuits;

FIG. 27 is an enlarged central sectional view through the body of a preferred form of the new proportional flow control valve but showing the new valve used for the reverse flow of oil or like hydraulic fluid through the regulated flow passage, as illustrated diagrammatically in FIG. 26;

FIG. 28 is a diagrammatic view illustrating a typical use of the new proportional flow control hydraulic valve and the energizing circuit and the operating solenoid for the movable pilot valve member and the manually operable remote control device therefor in which a solenoid-operated hydraulic directional flow control device is embodied in and is under the control of the energizing circuit;

FIG. 29 is a diagrammatic view illustrating another typical use of the new proportional flow control hydraulic valve and the manually operable remote control device therefor used in a hydraulic system which embodies a directional flow control device, a hydraulic cylinder and a hydraulic pump;

FIG. 30 is a diagrammatic view illustrating another typical use of the new proportional flow control hydraulic valve and the manually operable remote control device of the invention used in a hydraulic circuit which embodies a pressure compensated hydraulic pump;

FIG. 31 is a diagrammatic view illustrating another use of the invention with a pair of the new proportional flow control hydraulic valves of the present invention having the by-pass outlet port therein closed or plugged to provide a free reverse flow arrangement, and the new proportional flow control valves used as two-port pressure-compensated flow regulators, as illustrated in FIGS. 26 and 27, in a hydraulic circuit which embodies a so-called meter-out arrangement to each end of a double acting cylinder;

FIG. 32 is a diagrammatic view illustrating an additional typical use of the invention in which a pair of the new proportional flow control hydraulic valves of the present invention are used to control the hydraulic operating circuits for automotive vehicle sand, salt and fertilizer spreader apparatus;

FIG. 33 is a diagrammatic view illustrating another typical use of the new proportional flow control hydraulic valve of the present invention in a hydraulic circuit which includes a hydraulic pump and a hydraulic piston-cylinder operating device;

FIG. 34 is an enlarged central sectional view, comparable to FIG. 10, through the body of a modification of the new proportional flow control hydraulic valve and showing the movable parts thereof in the positions which they occupy when the energizing circuit for the operating solenoid for the movable pilot valve is in a deenergized condition;

FIG. 35 is an enlarged central sectional view of the modification of the new proportional flow control hydraulic valve illustrated in FIG. 34, but showing the movable parts thereof in the positions which they occupy when the energizing circuit for the operating solenoid for the movable pilot valve member is in an energized condition;

FIG. 36 is a fragmentary perspective view of the hydraulic fluid control valve member which is embodied in the modification of the invention shown in FIGS. 34 and 35;

FIG. 37 is a transverse sectional view on line 37—37 in FIG. 36;

FIG. 38 is a transverse sectional view on line 38—38 in FIG. 36; and

Figure 39:
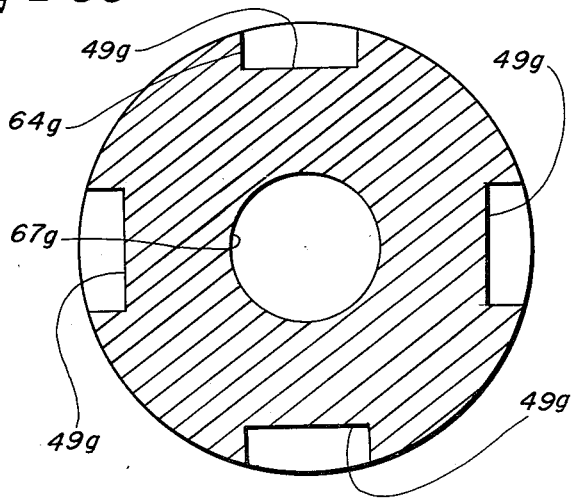

FIG. 39 is a transverse sectional view on line 39—39 in FIG. 36.

DETAILED DESCRIPTION OF THE PROPORTIONAL FLOW CONTROL HYDRAULIC VALVE UNIT ILLUSTRATED IN FIGS. 1 TO 4, INCLUSIVE, 10, 11, 13, 13A, 14 TO 23, INCLUSIVE, AND 24

A preferred and typical embodiment of the new proportional flow control hydraulic valve unit is illustrated in FIGS. 1 to 4, inclusive, 10, 11, 13, 13A and 14 to 23, inclusive, and 24, of the drawings, wherein it is generally indicated at 35, and comprises a generally rectangular-shaped valve body or housing 36 which includes side walls 37, end walls 38 and 39, a top wall 40, and a bottom wall 41, and which may be made of any suitable steel or like machineable metal. Mounting holes 251 are provided in the body 36 of the valve 35 for the reception of fastening elements by which the valve 35 may be attached to any suitable supporting surface (FIGS. 10 and 11).

The valve housing or body 36 has a fluid inlet port 42 formed therein and which opens thereinto from the top wall 40 of the valve housing or body 36 and may be connected to any source of oil or other hydraulic fluid from a hydraulic pump, or the like, in a hydraulic circuit. The valve housing or body 36 also has an internally threaded regulated flow outlet port 43 and an internally threaded by-pass outlet port 44 therein and which open outwardly from the bottom wall 41 of the valve body or housing 36. The regulated flow outlet port 43 may be connected in a hydraulic circuit (not shown) to any hydraulically operated device such, for example, as those hereinbefore referred to and which may be operated under control of the new proportional flow control hydraulic valve 35, and the by-pass outlet port 44 may be connected to a suitable fluid reservoir or other part of the hydraulic system in which the new proportional flow control hydraulic valve 35 may be used.

THE REGULATED FLOW PASSAGE 45 AND THE BY-PASS FLOW PASSAGE 46

The valve housing or body 36 of the new proportional flow control valve 35 has a novel arrangement of fluid flow passages formed therein including a regulated flow passage, generally indicated at 45, and a by-pass flow passage generally indicated at 46. The regulated flow passage 45 leads from the inlet port 42 to the regulated flow outlet port 43 and is adapted to conduct a predetermined, controlled and variable volume or body of oil or like hydraulic fluid from the inlet port 42 to the regulated flow outlet port 43 in direct linear relation to the arc or degree of manual movement and manual setting of a manually operable remote control lever which is embodied in the invention, as will be explained hereinafter.

The by-pass flow passage 46 includes the inlet port 42 and an annular channel 47 which is formed in the body 36 of the new valve 35 (FIGS. 10, 11 and 20) and which encircles the hydraulic fluid control valve chamber 48 and has an outlet 57 (FIGS. 10 and 11) into a check valve chamber 58; an inclined passageway 59; a hydraulic pressure compensating valve chamber 60-60A; and a port 61 which leads into the by-pass flow passage outlet port 44.

The regulated flow passage 45 includes the inlet port 42; a part of the annular channel section 47 of the by-pass flow passage 46, which encircles the hydraulic fluid control valve chamber 48 (when the valve 35 is in energized condition, as in FIG. 11); the hydraulic fluid control valve chamber 48; and a group of crescent-shaped hydraulic fluid control valve ports 49 (FIGS. 10, 11, 15, 16 and 17) which are formed in the body of a hydraulic fluid control valve member 63–64 (FIGS. 10, 11, 15, 16 and 19) but are closed by the generally cylindrical wall of the hydraulic fluid control valve chamber 48 when the energizing circuit and the operating solenoid for the movable pilot valve member 84 are in deenergized condition, as in FIG. 10, but are opened by movement of the hydraulic fluid control valve member 63–64 when the energizing circuit and the operating solenoid 108–117 for the movable pilot valve member 84 are energized, as in FIG. 11; the port 51 in the wall 52 of the valve body 36 of the new proportional flow control valve 36 (FIGS. 10 and 11); the inclined passage 53; the part or section 60 of the pressure compensating valve chamber 60–60A; the port 55 in the wall 56 of the valve body 36; and the regulated flow outlet port 43 (FIGS. 10 and 11).

THE HYDRAULIC FLUID CONTROL VALVE UNIT FOR DIVERTING A PROPORTIONAL PART OF THE FLOW OF HYDRAULIC FLUID FROM THE INLET PORT 42 AND THE BY-PASS FLOW PASSAGE 44 INTO THE REGULATED FLOW PASSAGE 45 (FIGS. 10, 11, 15, 16, 17 AND 19)

The preferred form of the invention are illustrated in FIGS. 10, 11, 15, 16, 17 and 19, includes a hydraulic flow control valve unit which is generally indicated at 63 (FIGS. 10, 11, 15, 16, 17 and 19) which is movably mounted in the hydraulic fluid control valve chamber 48 wherein it is adapted to direct a proportional part of the flow of hydraulic fluid from the inlet port 42 and the annular channel section 47 of the by-pass flow passage 46 through the group of crescent-shaped hydraulic fluid control valve ports 49 (FIGS. 10, 11, 15, 16, 17 and 19) through the hydraulic fluid control valve chamber 48 into the inclined section 53 of the regulated flow passage 45, in accordance with the predetermined setting of the manually operable control device which is embodied in the invention, as will be explained hereinafter.

The hydraulic fluid flow control valve 63 includes a valve body 64 which is movably mounted in the valve chamber 48 and has end portions 65 and 66. A pair of centrally arranged longitudinally extending concentric bores or passages 67 and 68 are formed in the body 64 of the valve 63 and a biasing means in the form of a coil spring 69 is mounted on one end portion 70 of the valve body 64 (FIGS. 10, 11 and 15) which is of reduced diameter relative to the main body of the valve member 64, and the coil spring 69 normally biases the valve body 64 in a direction (left to right, FIG. 10) to close the group of crescent-shaped hydraulic fluid control ports 49, which will be described hereinafter. The inner end portions 71 and 72, respectively, of the central bores or passages 67 and 68 in the valve body 64 have outlet orifices 215 therein, and a filter unit 73 is mounted on the valve body 64 at the inner end portions 71–72 of the central passages or bores 67–68, respectively, and over the outlet orifices 215 (FIGS. 10, 11, 15 and 16).

As shown in FIGS. 10, 11, 15, 16, 17 and 19, the group of hydraulic fluid control valve ports 49 are formed by arcuate or crescent-shaped recesses or cavities 216 which are formed in an end portion 217 of the generally cylindrical valve body member 64 (FIGS. 17 and 19) in cooperation with the internal wall surface of the valve chamber 48 (FIGS. 15, 16 and 17).

The arrangement of the parts thus far described is such that when the new proportional flow control hydraulic valve 35 is in its neutral position, as in FIG. 10, the main body of oil or like hydraulic fluid entering the inlet port 42 from a hydraulic pump or other device in a hydraulic circuit in which the new valve 35 is arranged, flows from the inlet port 42 around the valve chamber 48 through the annular channel section 47 of the by-pass flow passage 46 (FIGS. 10, 11 and 20), through the check valve chamber 58, inclined passage 59, the end portion 60 of the pressure compensating valve chamber 60–60A, and port 61 into the by-pass outlet port 44 from which the hydraulic fluid may be directed to a reservoir or otherwise used and circulated in a hydraulic system in which the new proportional flow control valve 35 may be used.

However, as will be explained more fully hereinafter, the biasing spring 69 on the reduced diameter portion 70 of the hydraulic flow control valve member 63–64 normally urges the hydraulic fluid control valve member 63–64–70, against the balanced opposing forces and the hydraulic pressure of the hydraulic fluid in the valve chamber 48, into the position in which the parts are shown in FIG. 10, with the cylindrical body of the hydraulic fluid control valve member 64–64–70 engaging the wall of the valve chamber 48 and preventing any part of the hydraulic fluid flowing from the inlet port 42 into the annular channel section 47 of the by-pass flow passage 46 from flowing into the hydraulic fluid control valve chamber 48 and into or through the group of valve ports 49 (FIGS. 10, 11, 16, 17 and 19) into the regulated flow passage 45 and thence into the regulated flow outlet port 43.

Hence, when the parts of the new proportional flow control hydraulic valve 35 are disposed as in FIG. 10, the entire body or volume of hydraulic fluid entering the inlet port 42, except for a relatively small volume or body of the hydraulic fluid which flows from the inlet port 42 into the auxiliary or pilot flow passage 74–75–76, (which will be described hereinafter) flows from the inlet port 42 through the annular channel section 47 of the by-pass flow passage 46 and thence through the parts 59–60A and 61 of the by-pass flow passage 46 to the by-pass flow outlet port 44.

THE AUXILIARY OR PILOT FLOW PASSAGE AND THE PILOT VALVE UNIT EMBODIED THEREIN (FIGS. 10, 11, 13, 13A, 14 AND 15)

The new proportional flow control hydraulic valve 35 and the valve body 36 therein embody an auxiliary or pilot flow passage which is generally indicated at 74 (FIGS. 10, 11 and 13) and which includes a first branch 75 which extends to the left and a second branch 76 which extends to the right from the inlet port 42, as seen in FIGS. 10 and 11.

The branch 75 of the auxiliary or pilot flow passage 74 has an internally screw threaded portion or bore 77 formed therein and an externally threaded neck portion 78 of a pilot valve seat member 79 is threaded into the internally threaded portion 77 of the branch 75 of the auxiliary or pilot flow passage 75, and an internal centrally arranged bore or passage 80 is formed in the neck portion 78 of the pilot seat valve member 79 (FIGS. 10, 11 and 13). An orifice 249 is formed in the neck portion 78 of the pilot valve seat member 79 and provides the fluid inlet from the portion 189 of the branch 75 of the pilot flow passage 74 (FIGS. 10 and 11). A filter 190 is mounted on the neck portion 78 of the pilot valve seat member 79 over the orifice 249 (FIGS. 10 and 11).

The pilot valve seat member 79 has an enlarged outer end portion 81 in which a pilot valve seat 82 is formed and the enlarged portion 81 of the pilot valve seat member 79 has an enlarged centrally arranged internal chamber 83 formed therein (FIGS. 10, 11, 13 and 14). A movable pilot valve member 84 is mounted in the centrally arranged chamber 83 of the pilot valve seat member 79–81 and the movable pilot valve member 84 has a tapered valve head portion 85 at its inner end which is adapted to be moved toward and into engagement with the pilot valve seat 82 (FIGS. 10, 11 and 13), as will be explained hereinafter.

The enlarged portion 81 of the pilot valve seat member 79 is arranged in a chamber 86 which is formed in the body 36 of the valve unit 35 and which is normally closed by an externally threaded closure plug or member 87 which is removably threaded into an internally threaded recess 88 which is formed in the body 36 of the valve unit 35 (FIGS. 10 and 11).

The chamber 83 of the centrally arranged passage or bore 77 in the pilot valve seat member 79–81 opens into the chamber 86 which, in turn, communicates, by way of a port 89 which is formed in the body 36 of the valve 35, with a passage 90 which, in turn, leads by way of an inlet port 91, which is formed in one end wall 92 of the hydraulic fluid control valve chamber 48, into the central bore or passage 67 in the body 64–70 of the hydraulic fluid control valve member 63–64–70 (FIGS. 10, 11 and 15).

As shown in FIGS. 10, 11, 13 and 14, the body 219 of the movable pilot valve member 84 is generally square or rectangular in cross sectional form but has a plurality of rounded or arcuate surfaces 220 which engage the adjacent inner wall surface of the pilot valve chamber 83 so as to guide the movable pilot valve member 84 during movement thereof in the pilot valve chamber 83 (FIG. 14). However, the movable pilot valve member 84 has a plurality (shown as four) of radially arranged flat surfaces 221 formed therein which cooperate with the adjacent wall surface of the pilot valve chamber 83 to form flow passages or channels 222 through the pilot valve chamber 83 (FIGS. 13 and 14).

The other branch 76 of the auxiliary or pilot flow passage 74 includes an internally threaded bore 93 which is formed in the body 36 of the valve 35 and in which an externally threaded orifice member 94 is removably mounted. The orifice member 94 has a centrally arranged passage or bore 95 formed therein which communicates at its inner end with an orifice 250 which opens into a portion 96 of the branch passage 76 of the pilot flow passage 74 and which, in turn, communicates with the inlet port 42, and a filter unit 97 is mounted on the orifice member 94 over the orifice 250 within the portion 96 of the branch passage 76 of the pilot flow passage 74 (FIGS. 10 and 11).

The orifice member 94 has a transverse passage 98 formed therein which communicates with a port 99 which is formed in a wall portion 100 of the valve body 36 and the port 99, in turn, communicates with a port 101 which communicates by way of a port 102 with the central bore or passage 68 in the body 64–70 of the hydraulic fluid control valve member 63 (FIGS. 10, 11 and 18).

The transverse passage 98 in the orifice member 94 opens into a passage 103 which has an internally threaded portion 104 which is formed in the valve body 36 and which is closed by a removably mounted externally threaded closure member or plug 105, and the ports 101–102 are closed by an externally threaded closure member or plug 106 which is threaded into an internally threaded opening 107 which is formed in a wall of the valve body 36 (FIGS. 10, 11 and 15).

THE SOLENOID DEVICE FOR OPERATING THE MOVABLE PILOT VALVE MEMBER 84 (FIGS. 10, 11 AND 12)

The present invention includes a solenoid device for operating the movable pilot valve member 84 and this solenoid device illustrated in FIGS. 10, 11 and 12, wherein it is generally indicated at 108 and includes a generally cylindrical guide member 109 having a pin 115 slidably mounted in a guide passage 116 formed therein, a plunger 110, a solenoid coil 117, and a stop member 272 for the solenoid plunger 110. The solenoid 108 is removably attached to the end wall 39 of the valve body 36 by means of an externally threaded fastening member 111 which is threaded into an internally threaded recess 112 in the end wall 39 of the valve body 36, and the solenoid guide member 109 has an externally threaded inner end portion 113 which is threaded into an internally threaded portion 114 of the fastening member 111 (FIGS. 10 and 11).

The pin 115 of the solenoid 108 has an inner end portion which is adapted to be moved into engagement with the movable pilot valve member 84 by energization of the solenoid coil 117 which is embodied in the solenoid 108 and has electrical conductors 118 which are connected to an electrically energized solenoid-operating circuit 175 (FIG. 12) which will be described hereinafter.

THE PRESSURE-COMPENSATING VALVE DEVICE (FIGS. 10, 11, 21, 22 AND 23)

The new proportional flow control hydraulic valve 35 includes a pressure-compensating valve device, which is generally indicated at 54 (FIGS. 10, 11, 21, 22 and 23) and is arranged in a two-part pressure compensating valve chamber 60-60A which is formed in the body 36 of the new proportional flow control valve 35.

The pressure compensating valve 54 includes a generally cylindrical hollow valve body member 119 (FIGS. 10, 11, 21, 22 and 23) which is slidably mounted in the pressure compensating valve chamber 60-60A and includes a pair of coaxial cylindrical rod members 120 and 121, the inner end portions of which are attached to a coupling member 122 (FIGS. 10 and 11). A coil spring 123 is mounted in one end portion 124 of the hollow valve body member 119 and has one end portion thereof mounted on the coupling member 122 with the other end portion thereof abutting the end wall 125 of the cylindrical hollow valve body member 119. The pressure compensating valve device 54 also includes a second coil spring 126 which is mounted on the rod member 121, within the part or section 60 of the pressure compensating valve chamber 60-60A, and has one end portion thereof abutting a closure plate 127 which closes one end or section 60 of the pressure compensating valve chamber 60-60A and is attached to the wall 38 of the valve body 36 by fastening elements in the form of bolts 128; the other end portion of the coil spring 126 being mounted on the coupling member 122 (FIGS. 10, 11, 21 and 23).

A pair of spaced annular flanges or valve heads 129 and 130 are provided on the hollow valve body member 119–124. The upper end portion of the annular flange or valve head 129 projects into a cavity 131 which is formed in the body 36 of the valve 35 and the lower end portion thereof projects into a port 55 above the regulated flow outlet port 43 and the annular flange or valve head 129 is adapted to engage a valve seat 248, as will be explained hereinafter in connection with the operation of the pressure compensating valve device 54.

The upper end portion of the other annular flange or valve head 130 projects into a cavity 132 which is formed in the body 36 of the valve 35 and the lower end portion thereof projects into the port 61 above the by-pass flow outlet port 44, and the annular flange or valve head 130 is adapted to engage a valve seat 246 which is formed in the body 36 of the valve 35 (FIGS. 10, 11 and 21), as will be described hereinafter.

The opposite end section or part 60A of the pressure compensating valve chamber 60-60A is closed by a closure plate 133 which is attached to the wall 39 of the body 36 of the valve 35 by fastening elements in the form of bolts 134 (FIGS. 10, 11 and 21).

The operation of the pressure compensating valve unit 54 will be explained hereinafter in connection with the description of a typical example of the operation of the new proportional flow control hydraulic valve 35.

THE CHECK VALVE DEVICE (FIGS. 10, 11 AND 27)

The new proportional flow control hydraulic valve 35 includes a check valve device which is illustrated in FIGS. 10, 11 and 27, wherein it is generally indicated at 135, and includes the cylindrical valve chamber 58 which is formed in the valve body 36. The check valve device 135 includes a generally cylindrical movable valve rod member 136 on which a check valve head 137 is mounted, and the check valve head 137 is adapted to engage a check valve seat 138 which is formed partly in a wall 139 of the valve body 36 and partly in a wall 140 of the valve body 36. The upper end portion of the check valve head 137 projects into the port 57 and the lower end portion thereof projects into a cavity 141 which is formed in the body 36 of the valve 35 (FIGS. 10, 11 and 27).

The check valve rod member 136 has an annular flange 142 formed thereon at the opposite end thereof and a coil spring 143 is mounted in the check valve chamber 58 between the annular flange 142 and an externally threaded plug member 144 which is removably mounted in an internally threaded recess 145 which is formed in the wall 39 of the valve body 36 (FIGS. 10, 11 and 27).

The arrangement of the parts of the check valve unit 138 is such that the coil spring 143 normally urges the check valve rod 136 and the check valve head 137 thereon into engagement with the check valve seat 138 so as to prevent the flow of hydraulic fluid from the port 57 of the by-pass flow passage 46 and the check valve chamber 58 into the regulated flow passage 45, as will be described more fully hereinafter.

THE MANUALLY OPERABLE REMOTE CONTROL DEVICE FOR CONTROLLING THE OPERATION OF THE OPERATING SOLENOID 108 FOR THE MOVABLE PILOT VALVE MEMBER 84 AND THE ENERGIZING CIRCUIT FOR THE SOLENOID 108 (FIGS. 5, 6, 6A, 6B, 6C, 6D, 6E, 7, 8, 9 AND 12)

THE MANUALLY OPERABLE REMOTE CONTROL DEVICE

The present invention includes a manually operable remote solenoid control device for controlling the operation of the operating solenoid 108 for the movable pilot valve member 84, and an energizing circuit therefor, which are shown in FIGS. 5, 6, 6A, 6B, 6C, 6D, 6E, 7, 8, 9 and 12 of the drawings, wherein the manually operable remote control device is generally indicated at 146 and includes a housing 147 which includes generally parallel front and rear walls 148 and 149, respectively, generally parallel side walls 150, and generally parallel top and bottom walls 151 and 152, respectively.

The manually operable solenoid control device 146 includes a manually operable remote control handle lever 153 having a handle knob 154 on the upper and outer end portion thereof, and the manually operable remote control lever 153 includes an offset or angled lower end portion 155 which is pivotally mounted, as at 156, on and between a pair of bifurcated end portions 165 of a generally cylindrical shaft 160 (FIGS. 5, 6 and 6A).

A cylindrical recess 158 is provided in the wall 157 of the housing 147 of the manually operable remote control device 146 (FIGS. 6 and 8) and a hollow cylindrical bearing sleeve member 159 is mounted in the recess 158. The body of the generally cylindrical shaft 160 is mounted in the hollow cylindrical bearing sleeve member 159 and the shaft 160 has a cylindrical bore or spring chamber 161 extending partially therethrough. A resetting and latching coil spring 162 is mounted in the bore or spring chamber 161 and the inner end portion of the resetting and latching coil spring 162 abuts against a wall 163 of the shaft 160 at the inner end of the spring chamber 161 and the outer end portion of the resetting and latching coil spring 162 abuts against the angled lower end portion 155 of the manually operable remote control lever 153–154 (FIG. 6).

A U-shaped latching groove or slot 166 is formed in the wall 157 of the manually operable remote control device 147 and the manually operable control lever 153–154 is normally urged into latched, centered and neutral position in the latching groove or slot 166 by the resetting and latching coil spring 162 as shown in full lines in FIGS. 5 and 6 and as shown in FIG. 7.

A sprocket gear 168 is mounted on the shaft 160 and the shaft 160 has a flattened cam portion 164 on its peripheral surface and the flattened cam portion 164 on the peripheral surface of the shaft 160 is adapted to engage alternately movable switch-operating arms 170 of a pair of microswitches 171 which are embodied in the energizing circuit 175 for the operating solenoid 108 and the outer end portions of which ride upon the generally cylindrical or annular peripheral surface of the cylindrical shaft 160 by which they are normally maintained in open circuit position (FIGS. 6, 6A and 9), but are spring-urged into closed circuit position, as will be explained more fully hereinafter.

As shown in FIGS. 6, 6A, 6B, 6C, 6D, 6E and 9, the sprocket gear 168 meshes with a second and smaller sprocket gear 172 which is mounted on a shaft 173 which is rotatably mounted in the housing 147 of the manually operable remote control device 146 and has a potentiometer wiper or contact arm 252 mounted thereon (FIG. 6A). The wiper or contact arm 252 engages and is adapted to be moved across the surface of a voltage control device in the form of a stationarily mounted potentiometer 174 which is embodied in the energizing circuit for the operating solenoid 108 for the movable pilot valve member 84, the energizing circuit being generally indicated at 175 (FIG. 12).

As shown in FIGS. 6 and 6A to 6E, inclusive, the shaft 160 which supports the manually operable control lever or handle 153–154 is urged into its normal centered and neutral position by a resetting and centering coil spring 169 which is arranged around the shaft 160 and has inner and outer end portions 169A and 169B, respectively. A stud or pin 217 is stationarily mounted on an arm 253 of a supporting bracket 256 which is attached, as at 257 and 258 to supporting members 259 and 260, respectively, which are attached to the wall 157 of the remote control device housing 147 so that the resetting and centering coil spring 169 is disposed between the sprocket gear 168 and the supporting bracket 253–256 (FIGS. 6 and 6A). As shown in FIG. 6A the supporting bracket 253–256 has a bearing member 254 mounted therein and one end portion of the shaft 160 is journaled in the bearing member 254 (FIGS. 6A and 6B).

A stud or pin 255 is mounted on the sprocket gear 168, adjacent the peripheral edge thereof, and projects laterally therefrom and is adapted to engage at different times the end portions 169A and 169B of the resetting and centering coil spring 169 when the manually operable control lever 153–154 is pivoted at 156 into unlatched position, as in dotted lines in FIG. 6, and the shaft 160 and the sprocket gear 168 thereon are rotated in either direction from their normal neutral and centered position by the manually operable remote control lever 153–154, thereby tensioning the resetting and centering coil spring 269 (FIGS. 6C, 6D and 6E).

The arrangement of the parts of the remote control device 146, as described above, is such that when the manually operable remote control lever 153–154 is manually and pivotally moved from its normal and centered position, as in full lines in FIGS. 5 and 6, and as in FIG. 7, against the action of the resetting and latching coil spring 162, which is thereby tensioned, and is manually pivoted or rotated on its supporting shaft 160 and the bifurcated end portions 165 thereof, to either right or left of its normal centered and latched position, it is manually held in the selected position by the operator while the operation desired continues. During this operation the stud or pin 255 on the sprocket gear 168 engages one of the end portions 169A or 169B of the resetting and centering coil spring 169, thereby tensioning the resetting and centering coil spring 169 so that when the operator manually releases the manually operable remote control lever 153–154 the then tensioned coil spring 169 will act, through the stud or pin 255 on the sprocket gear 168, to rotate the sprocket gear 168 and the shaft 160 and the manually operable remote control lever 153–154 thereon back into their normal neutral and at rest position, whereupon the manually operable remote control lever 153–154 is urged into its normal neutral and latched position, in the latching slot 166 in the wall 157 of the remote control device housing 147 by the then tensioned, resetting and latching coil spring 162.

During this operation, as will be referred to hereinafter, the switch operating arm 170 for one of the microswitches 171 will ride off the curvilinear portion of the peripheral surface of the shaft 160 onto the flattened cam surface 164 thereof, and this action will cause the switch operating arm 170 of the microswitch 171 to move from its normal spring-urged open circuit position into closed circuit position, thereby energizing the energizing circuit 175 for the operating solenoid 108–117 for the movable pilot valve member 84, as will be discussed hereinafter.

Likewise, during this operation, the pivotal movement of the manually operable remote control lever 153–154 and resulting rotary motion of the shaft 160–165 and the sprocket gear 168 thereon acts, through the sprocket gear 172, to rotate the wiper or contact arm 252 for the resistor or potentiometer unit 174, thereby causing a current flow through the energizing circuit 175 at a voltage which is directly related to the degree or arc of movement of the manually operable control lever 153–154 and of the wiper or contact arm 252 for the potentiometer 174.

THE ENERGIZING CIRCUIT FOR THE OPERATING SOLENOID 108 FOR THE MOVABLE PILOT VALVE MEMBER 84 (FIG. 12)

The energizing circuit 175 for the operating solenoid 108 for the movable pilot valve member 84 is shown in FIG. 12 and includes a suitable source 176 of electrical current which is connected by a conductor line 177 through a series resistor 261 and a blocking diode 178, thence by way of a line 179–118 to the coil 117 of the operating solenoid 108, and thence by way of a line 180 to a connection 186 for the wiper arm 252 of the potentiometer 174. A line 181 leads from one terminal of the potentiometer 174 to the connection 182 for the movable switch-operating arm 170 of one of the microswitches 171, and a line 183 leads from the other terminal of the potentiometer 174 to the connection 184 for the movable switch-operating arm 170 of the other microswitch 171.

A voltage regulating (zener) diode 262 is connected between the series resistor 261 and the blocking diode 178 in parallel with the solenoid energizing circuit 175 (FIG. 12).

As shown in FIGS. 5 and 6, the conductor lines 179–180 in the solenoid energizing circuit 175 (FIG. 12) lead into the housing 147 for the manually operable remote control device 146 through an electrical connector unit 188.

As shown in FIG. 12, there are two microswitches 171 in the energizing circuit 175 for the solenoid 108–117 and movement of the manually operable remote control lever or handle 153–154 to either side of its center will cause the normally open spring-loaded switch-operating arm 170 of one of the microswitches 171 to move into closed circuit position, thereby energizing the energizing circuit 175 for the solenoid 108–117. Likewise, in certain uses of the invention, such as illustrated in FIG. 28, in which two solenoid circuits are employed, it is necessary to employ two of the microswitches 171. Thus in certain uses of the invention, two switches may be employed to control two of the new proportional valves 35 or with each of two switches used to control one-half of a four way solenoid operated directional control valve.

A line 263–173 leads from the microswitches 171—171 to the potentiometer 174 (FIG. 12).

DETAILED DESCRIPTION OF THE OPERATION OF THE PROPORTIONAL FLOW CONTROL HYDRAULIC VALVE 35 WHEN THE PARTS THEREOF ARE DISPOSED AS IN FIG. 10 AND THE MOVABLE MANUALLY OPERABLE REMOTE CONTROL LEVER 153–154 IS IN ITS NEUTRAL LATCHED AND CENTERED POSITION AND THE OPERATING SOLENOID 108–117 AND THE ENERGIZING CIRCUIT 175 THEREFOR ARE DEENERGIZED

The operating parts of the new proportional flow control hydraulic valve 35 are illustrated in FIG. 10 of the drawings in the position which they assume when the manually operable remote control handle or lever 153–154 for the manually operable remote control device 146 is disposed in its neutral, latched and centered position, as in full lines in FIGS. 5 and 6 and as in FIG. 7, and the operating solenoid 108–117 for the movable pilot valve member 84 and the energizing circuit 175 therefor (FIG. 12) are deenergized.

When the parts of the new valve 35 are so disposed, as in FIG. 10, the valve head 82 of the movable pilot valve member 84 is disposed out of engagement with the pilot valve seat 82 and the pilot valve chamber 83 and the passage 80 in the pilot valve seat member 78–81 are fully opened.

The main body or volume of oil or like hydraulic fluid flowing into the inlet port 42, as from a hydraulic pump, at a predetermined pressure such, for example, as 100 psi, and in a predetermined volume such, for example, as 12 gpm, will then flow from the inlet port 42 through the by-pass flow passage 46, as follows: From the inlet port 42 through the annular channel section 47 of the by-pass flow passage 46, around the hydraulic flow control valve chamber 48 for the hydraulic fluid control valve 63–64–70; thence through the outlet port 57 thereof into the check valve chamber 58; thence into the inclined passage 59; thence into the part of section 60A of the pressure-compensating valve chamber 60-60A; and thence through the port 61 into and out of the by-pass outlet port 44 from which the main body or volume of oil or like hydraulic fluid may be returned to the hydraulic system in which the new proportional flow control hydraulic valve 35 is incorporated, or returned to a fluid reservoir, or otherwise used.

At the same time, however, a relatively small portion of the main body or volume of oil or like hydraulic fluid flowing into the main inlet port 42, such, for example, as 0.15 gpm, at a pressure of 100 psi, will flow through the branch 76 of the pilot flow passage 74 into the regulated flow passage 45 as follows: From the inlet port 42 through the port 96, through the filter 97, through the orifice 250, through the passage 95–98 in the orifice plug member 94, through the passage 103–99 and ports 101–102 into the central bore or passage 68–72 in the hydraulic fluid flow control valve member 63–64–70, through the orifice 215, through the filter 73, port 51, through the inclined passage 53 into the part of section 60 of the pressure-compensating valve chamber 60-60A, and thence by way of the port 55 into the regulated flow passage outlet port 43 from which the relatively small volume of oil or like hydraulic fluid may be returned to the hydraulic system in which the new proportional flow control valve 35 is incorporated, or otherwise used.

When the parts are so disposed, as in FIG. 10, the main body or volume of oil or like hydraulic fluid flowing into the inlet port 42 at a predetermined pressure such, for example, as 100 psi, and in a predetermined volume such, for example, as 12 gpm, will flow from the inlet port 42, through the annular channel section 47 of the by-pass flow passage 46 to the by-pass flow passage 46 and thence through the by-pass flow passage 46 to the by-pass outlet port 44 and is prevented by the generally cylindrical body of the hydraulic fluid control valve member 64–70 from flowing from the annular channel section 47 of the by-pass flow passage 46 into the hydraulic fluid control valve chamber 48 and thence by way of the group of four crescent-shaped fluid control valve ports 49 out of the valve chamber 48, through the port 51 into the inclined section 53 of the regulated flow passage 45 and thence through the regulated flow passage 45 to the regulated flow passage outlet port 43.

However, during the operation, that is, when the parts of the new valve 35 are disposed as in FIG. 10, and the operating solenoid 108–117 for the movable pilot valve member 84 and the energizing circuit 175 therefor are deenergized, a relatively small volume or body of oil or like hydraulic fluid, such as 0.15 gpm, at a predetermined pressure, such as 100 psi, flowing through the branch passage 76 of the pilot flow passage 74, will flow into the hydraulic fluid control valve chamber 48 and against one end wall 66 of the body 64–70 of the hydraulic fluid control valve member 63, at a pressure of 50 psi, and thus urge the valve member 63-64-70 (right to left, FIG. 10) in the valve chamber 48 against the action of the biasing spring 69 which tends to bias the valve member 64–70 in a direction (left to right, FIG. 10) to move the group of four crescent-shaped hydraulic fluid flow valve control ports 49 (FIGS. 10, 11, 15, 16, 17 and 19) into position to establish communication or fluid flow from the annular channel section 47 of the by-pass flow passage 46 and the group of hydraulic fluid flow valve control ports 49 into the hydraulic fluid control valve chamber 48 and thence through the port 51 into the regulated flow passage 45.

While a relatively small fraction of oil or like hydraulic fluid from the inlet port 42, such as 0.15 gpm, and at a predetermined pressure, such as 100 psi, is thus flowing through the branch 76 of the pilot valve flow passage 74, a similar relatively small volume of the oil or like hydraulic fluid from the inlet port 42 will flow through the other branch 75 of the pilot flow passage 74 as follows: From the inlet port 42 into the pilot valve chamber 189, through the filter 190, through the orifice 249, through the central bore or passage 80 in the pilot valve seat member 78–81, past the then fully opened pilot valve seat 82, through the pilot valve chamber 83, through the port 89 into the chamber 90 and thence through the port 91 into the central bore or passage 67 in the body 64–70 of the hydraulic fluid control valve chamber 63. The relatively small body or volume of oil or like hydraulic fluid thus flowing through the branch 75 of the pilot flow passage 74 at a predetermined pressure such, for example, as 50 psi, acts with the biasing action of the spring 69 and in conjunction with the corresponding flow of oil or like hydraulic fluid flowing through the other branch 76 of the pilot flow passage 74 into the valve chamber 48, at a predetermined pressure, such as 50 psi, to maintain the movable valve member 64–70 in a static or balanced condition, against the action of the biasing spring 69, thereby maintaining the group of four crescent-shaped hydraulic fluid control ports 49 out of communication with the annular channel section 47 of the by-pass flow passage 46.

The flow of oil or like hydraulic fluid through the new proportional flow control hydraulic valve 35, when the parts are thus disposed as in FIG. 10, and the energizing circuit 175 and the operating solenoid 108–117 for the movable pilot valve member 84 are deenergized, and as described above, is further illustrated diagrammatically in FIG. 24 of the drawings.

SUMMARY OF THE OPERATION OF THE PROPORTIONAL FLOW CONTROL HYDRAULIC VALVE 35 WHEN THE PARTS THEREOF ARE DISPOSED AS IN FIG. 10 AND THE MANUALLY OPERABLE REMOTE CONTROL LEVER 153–154 IS IN ITS NEUTRAL CENTERED AND LATCHED POSITION AND THE ENERGIZING CIRCUIT 175 AND THE OPERATING SOLENOID 108–117 FOR THE MOVABLE PILOT VALVE MEMBER 84 ARE DEENERGIZED

As oil or like hydraulic fluid is introduced into the new proportional flow control hydraulic valve 35 by way of the inlet 42 the flow rate increases as the hydraulic pressure at the inlet 42 increases until a preselected hydraulic pressure, such as 100 psi is obtained, whereupon the oil or like hydraulic fluid will then flow through the two branches 75 and 76 of the pilot flow passage 74 at the rate of approximately 0.3 gpm, for the combined flow through both branches 75 and 76 of the pilot flow passage 74, and the hydraulic fluid flowing through both branches 75 and 76 of the pilot flow passage are combined or united at the outlet orifices 215—215 of the central bores or passages 67 and 68 in the body 64–70 of the hydraulic fluid control valve 63 from which the thus combined fluid flows through the filter 73, through the port 51 into the regulated flow passage 45 and thence to the regulated flow outlet port 43; there being no other flow of hydraulic fluid through the valve 35 at this time.

At this time there is then established a predetermined hydraulic pressure, such as 100 psi, at the inlet port 42, a hydraulic fluid pressure of 100 psi in both branches 75 and 76 of the pilot flow passage 74; a hydraulic pressure of 50 psi in the hydraulic fluid control valve chamber 48 at both ends of the hydraulic fluid control valve member 64–70; a hydraulic pressure of 100 psi in the part or section 60A of the pressure-compensating valve chamber 60-60A (left hand end portion, FIG. 10), and a hydraulic fluid pressure of approximately zero in the other part or section 60 of the pressure-compensating valve chamber 60-60A (right end portion, FIG. 10); no fluid flow through the by-pass outlet port 44; and approximately 0.3 gpm fluid flow out of the regulated flow passage outlet port 43.

It will be noted, in this connection, that the 100 psi pressure referred to above is a preselected minimum operating pressure for the design of the new proportional flow control valve 35 and has been selected to produce fast response, and repeatability, and to operate under practical spring forces, relatively small flows in the pilot flow passage 74–75–76, and the like.

However, as more oil or like hydraulic fluid is supplied to the inlet port 42, the resulting increase in the flow of the hydraulic fluid through the pilot flow passage 74–75–76 and through the outlet orifices 215—215 of the central bores or passages 67–68 in the hydraulic fluid control valve member 63–64–70 into the regulated flow passage 45, and thence into the pressure-compensating valve chamber 60-60A, are sensed in the part or section 60A of the pressure-compensating valve chamber 60-60A, and the biasing springs 123 and 126 on the pressure-compensating valve member 119–124 are able to maintain a total of only 100 psi in the part or section 60A only of the pressure-compensating valve chamber 60-60A (left hand end portion, FIG. 10), with the annular flange or valve head 130 on the body 124 of the pressure-compensating valve member 119–124 disposed in engagement with the valve seat 246, as in full lines in FIGS. 10 and 11. Hence, any increase in the hydraulic pressure in the part or section 60A of the pressure-compensating valve chamber 60-60A and in the by-pass flow passage 46 above 100 psi will result in movement of the pressure-compensating valve member 119–124 (left to right, FIG. 10), thus moving the annular flange or valve head 130 on the body 124 of the pressure-compensating valve member 119–124 out of engagement with the valve seat 246 (from full line position in FIG. 10 into full line position in FIG. 11), and thus allow such excess oil or like hydraulic fluid to flow from the part or section 60A of the pressure-compensating valve chamber 60-60A into the by-pass outlet port 44 and thereby reestablishing the desired 100 psi in the part or section 60A of the pressure-compensating valve chamber 60-60A and in the by-pass flow passage 46.

At this time the new proportional flow control valve 35 is in condition to respond to all hydraulic fluid pump flows at the inlet port 42, up to its rated flow capacity, and is in condition to perform its intended fluid flow-controlling and proportioning function which may be described as the ability of the new valve 35 to select each and any one of an infinite number of flow rates within its rated flow capacity between a specified minimum and a specified maximum flow condition such, for example, as between 0.3 and 15.0 gpm, and to maintain such a selected flow rate over a specified minimum-maximum hydraulic pressure range across the valve 35 such, for example, as from 100 to 3000 psi at the regulated flow passage outlet port 43 and the by-pass flow passage outlet port 44.

DETAILED DESCRIPTION OF THE OPERATION OF THE PROPORTIONAL FLUID CONTROL VALVE 35 WHEN THE MANUALLY OPERABLE CONTROL LEVER 153–154 AND THE REMOTE CONTROL DEVICE 146 (FIGS. 5, 6 AND 7) ARE OPERATED TO ENERGIZE THE ENERGIZING CIRCUIT 175 (FIG. 12) FOR THE OPERATING SOLENOID 108–117 FOR THE MOVABLE PILOT VALVE MEMBER 84 AND THE MOVABLE PARTS OF THE VALVE 35 ARE DISPOSED AS IN FIG. 11

If and when the operator of a hydraulic machine or apparatus, such, for example, as the hydraulically operated boom of a lifting crane, or the like, with which the present invention is used, desires to move the boom into or through a predetermined part of its path of movement, this may be accomplished as follows: The operator manually grasps the manually operable remote control lever 153–154 and moves it on its pivotal mounting 156 (counterclockwise from full to dotted line position, FIG. 6), thereby moving the manually operable lever 153–154 out of its neutral and latched position, as in full lines in FIGS. 5 and 6, and as in FIG. 7, and at the same time tensioning the resetting and latching spring 162. The operator then manually rotates the lever 153–154 on its supporting shaft 160, within the cylindrical bearing 159, to either side of center as, for example, clockwise from full to dotted line position as in FIG. 5, thereby tensioning the resetting and centering spring 169, through the desired degree of arc corresponding to the extent or degree of movement which the operator desires to impart to the lifting boom or like device. When the operator has moved the manually operable remote control lever 153–154 to the desired point, he manually holds it in that position against the action of the resetting and centering coil spring 169, until the desired movement of the boom, or like device, has been accomplished, whereupon the operator manually releases the lever 153–154 to allow the then tensioned resetting and centering coil spring 169 to return the manually operable control lever 153–154 to its normal, neutral and centered position in which it is then urged into latched position, as in FIG. 7, by the resetting and latching coil spring 162.

When the manually operable control lever 153–154 for the remote control device 146 is thus rotated through the desired degree of arc to either side of center, it rotates the shaft 160–167 correspondingly and thereby causes the switch-operating arm 170 of one of the microswitches 171 to ride off the generally cylindrical or annular peripheral surface of the shaft 160 onto the flattened cam surface portion 164 thereof (FIG. 9), thereby causing the spring-urged switch-operating arm to move into closed circuit position, and thus closing circuit through the thus actuated microswitch 170–171 and the line 263–181 to the potentiometer 174 and thereby energizing the energizing circuit 175 for the operating solenoid 108–117 for the movable pilot valve member 84 (FIG. 12); it being noted, in this connection, that the switch-operating arms 170 of the microswitches 171 are spring-loaded into normally closed position, but are maintained in open circuit position while they ride the generally cylindrical or annular portion of the peripheral surface of the shaft 160.

When the manually operable control lever 153–154 and the shaft 160 are thus manipulated, the sprocket gear 168 on the shaft 160 is correspondingly rotated, thereby rotating the sprocket gear 172 and the potentiometer wiper or contact arm 252 thereon through a corresponding degree of arc, and thus moving the potentiometer wiper or contact arm 252 relative to and over the potentiometer 174 a linear distance or degree corresponding to the arc of rotation of the manually operable control lever 153–154, and thereby energizing the energizing circuit 175 and the solenoid coil 117 for the operating solenoid 108 for the movable pilot valve member 84 in direct relation to the degree of arc or movement of the manually operable control lever 153–154.

When the operating solenoid 108–117 for the movable pilot valve member 84 is thus energized it causes the solenoid plunger 110 and attached pin 115 to move from their normal or at rest position, as in FIG. 10 (left to right, into the position in which the parts are shown in FIG. 11). During this movement the solenoid pin 115 engages the movable pilot valve member 84 and moves it from its normal and fully opened position, as in FIG. 10, toward or into engagement with the pilot valve seat 82, and into a position such as is illustrated in FIG. 11. During this operation, the degree of movement of the movable pilot valve member 84 bears a direct linear relationship to the degree of arc or extent of movement of the manually operable control lever 153–154 from its neutral or at rest position, and the resultant energization of the energizing circuit 175 for the solenoid 108–117. Depending upon the extent of movement of the manually operable remote control lever 153–154, this operation will either partially or fully close the pilot valve chamber 83 by engagement of the valve head 85 on the movable pilot valve member 84 against the pilot valve seat 82 and will thus correspondingly reduce the volume of flow of oil or like hydraulic fluid from the inlet port 42 through the branch 75 of the pilot flow passage 74 into the hydraulic fluid control valve chamber 48 and into the central bore or passage 67 in the body 64–70 of the movable hydraulic fluid control valve member 63-64-70 (FIG. 11). However, as the movable pilot valve member 84 is thus moved toward or into engagement with the pilot valve seat 82, a reduced volume of oil or like hydraulic fluid will flow past the pilot valve seat 82 through the fluid-conducting channels 222 (FIGS. 10, 11, 13 and 14) and thence through the remaining parts of the branch 75 of the pilot flow passage 74 into the central bore or passage 67 in the hydraulic fluid control valve member 64–70.

As the volume of oil or like hydraulic fluid thus flowing through the branch 75 of the pilot flow passage 74, at a predetermined pressure, such as 50 psi, and in a predetermined volume, such as 0.15 gpm, is thus decreased by the action of the solenoid plunger 116 and attached pin 115 against the movable pilot valve member 84, the static hydraulic pressure equilibrium in the hydraulic fluid control valve chamber 48 is unbalanced by the corresponding reduction of the hydraulic force operating on the movable valve member 64–70 against the action of the biasing spring 69 which maintains the movable valve member 64–70 in a position, as in FIG. 10, to prevent fluid flow from the annular channel section 47 of the by-pass flow passage 46 into the group of four crescent-shaped hydraulic fluid control ports 49 in the body 64 of the hydraulic fluid control valve member 63. The reduction in the hydraulic force thus operating on the hydraulic fluid control valve member 63–64–70 and tending to move it (left to right, FIG. 10) in the valve chamber 48, causes the hydraulic force of the hydraulic fluid flowing from the inlet port 42 through the other branch 76 of the pilot flow passage 74 into the valve chamber 48 and into the central bore or passage 68 in the valve member 64–70 to overcome the biasing action of the spring 69 and thereby move the valve member 64–70 in the valve chamber 48 from the position in which it is shown in FIG. 10 into the position in which it is shown in FIG. 11. This movement of the valve member 64–70 moves the group of four crescent-shaped hydraulic fluid control ports 49 in the body 64 of the valve member 63–64 into communication with the annular channel section 47 of the by-pass flow passage 46 to an extent which is in direct linear relation to the movement of the manually operable control lever 153–154 and the resulting energization of the energizing circuit 175 and the operating solenoid 108–117 for the movable pilot valve member 84 and the corresponding linear movement of the solenoid plunger 110 and attached pin 115 and the movable pilot valve member 84.

When the group of four crescent-shaped hydraulic fluid control ports 49 are thus moved into communication with the annular channel section 47 of the by-pass flow passage 46, by movement of the valve member 64–70 against the action of the biasing spring 69 (right to left from the position in which the parts are shown in FIG. 10, into the position in which they are shown in FIG. 11), the group of four crescent-shaped hydraulic flow control ports 49 are moved into either partial or full communication with the annular channel section 47 of the by-pass flow passage 46 so that a corresponding volume or body of oil or like hydraulic fluid flowing into the inlet port 42 will then flow and be diverted from the annular channel section 47 of the by-pass flow passage 46 into the hydraulic fluid control valve chamber 48, through the group of four crescent-shaped hydraulic fluid flow control ports 49, through the port 51, into the inclined passage 53 of the regulated flow passage 45, and thence by way of the part or section 60 of the pressure-compensating valve chamber 60-60A, and port 55, into the regulated flow outlet port 43 from which the hydraulic fluid may be returned to the hydraulic system in which the valve 35 is incorporated, or otherwise used.

The volume or body of oil or like hydraulic fluid which is thus diverted from the annular channel section 47 of the by-pass flow passage 46 through the group of four crescent-shaped fluid flow valve control ports 49 into the valve chamber 48 and thence into the regulated flow outlet passage 45, bears a direct linear relationship to the degree or arc of movement of the manually operable remote control lever 153–154 and resultant energization of the energizing circuit 175 and corresponding movement of the solenoid plunger 110 and attached solenoid pin 115 and the related linear movement of the movable pilot valve member 84.

The flow of the hydraulic fluid from the inlet port 42 which is diverted from the annular channel section 47 of the by-pass flow passage 46 through the group of four crescent-shaped valve ports 49 into the hydraulic fluid control valve chamber 48 and thence into the regulated flow passage 45, when the parts are disposed as in FIG. 11, and as described above, is illustrated diagrammatically in FIG. 25.

If and when the operator desires to reduce or cut-off entirely the fluid flow through the inlet port 42 and the annular channel section 47 of the by-pass flow passage 46, and thence through the group of four crescent-shaped valve ports 49 into the hydraulic fluid control valve chamber 48 and to the regulated flow passage 45, this is accomplished by manipulating the manually operable remote control lever 153–154 back toward or into its normal neutral and latched position, as in full lines in FIGS. 5 and 6 and as in FIG. 7, thereby correspondingly reducing the voltage and current flow from the potentiometer 173–174 through the energizing circuit 175 for the operating solenoid 108–117 for the movable pilot valve member 84 and thereby causing the solenoid 108 to move the solenoid plunger 110 and attached pin 115 from the position in which the parts are shown in FIG. 11 into the position in which they are shown in FIG. 10. The pressure of the hydraulic fluid from the inlet port 42 through the branch 75 of the by-pass flow passage 74 will thereupon cause the movable pilot valve member 84 to move away from the pilot valve seat 82 from the position in which it is shown in FIG. 11 into the position in which it is shown in FIG. 10, and thereby cause a resulting increase in fluid flow through the branch 75 of the by-pass flow passage 74 into the hydraulic fluid control valve chamber 48 which will restore the static or hydraulic pressure equilibrium of the hydraulic fluid pressure in the valve chamber 48 and thus enable the biasing spring 69 to move the movable valve member 64–70 back into position, as in FIG. 10, to prevent communication between all four of the crescent-shaped hydraulic fluid flow valve control ports 49 in the body 64 of the hydraulic fluid control valve member 63–64–70 and the annular channel section 47 of the by-pass flow passage 46.

In certain uses of the invention it may be desirable to employ two of the new proportional flow control valves 35 and in such instances the manually operable control lever 153–154 may be moved in a direction opposite to that described above, whereupon when the other switch-operating arm rides off the generally cylindrical or annular peripheral surface of the shaft 160, it will cause the switch-operating arm 170 of the second microswitch 171 to close a second energizing circuit, as 175, to the operating solenoid 108–117 to a second proportional flow control valve 35 or for each of the two switches used to control one-half of a solenoid-operated four-way directional flow control valve.

EXAMPLE OF THE OPERATION OF THE PROPORTIONAL FLOW CONTROL VALVE 35 (FIGS. 10 AND 11)

A typical example of the operation of the new proportional flow control hydraulic valve 35, as illustrated in FIGS. 10 and 11, is as follows: Assuming that the parts of the new proportional flow control valve 35 are disposed as in FIG. 10, and that there is a flow of 11.7 gpm of a rated volume of 12 gpm of oil or like hydraulic fluid through the inlet port 42 and through the by-pass flow passage 46 to the by-pass outlet port 44, and that there is a flow of 0.3 gpm through the two branches 75–76 of the pilot flow passage 74 into the regulated flow passage 45 to the regulated flow passage outlet port 43: If the operator then moves the manually operable remote control lever 153–154 and the shaft 160 to close one of the microswitches 171 and thereby energize the energizing circuit 175 and to move the potentiometer wipe or contact arm 252 through an arc of movement sufficient to actuate the potentiometer 173–174 and energize the energizing circuit 175 and the operating solenoid 108–117 for the movable pilot valve member 84, with, for example, 225 milliamperes of current, the solenoid 108–117 will cause the solenoid plunger 110 and the solenoid pin 115 to engage and move the movable pilot valve member 84 toward the pilot valve seat 82 until the hydraulic force across the pilot valve seat 82, multiplied by the area of the pilot valve seat 82, exactly balances the force of the solenoid plunger 110 and the solenoid pin 115, which, at this current value, will be approximately 1.1 pound. This movement of the movable pilot valve member 84 will result in a corresponding decrease in the hydraulic pressure in the hydraulic fluid control chamber 48, (at the left hand end of the hydraulic fluid control valve member 64–70 therein, as seen in FIGS. 10 and 11), and will cause a resultant hydraulic pressure differential in the hydraulic fluid control chamber 48 at opposite sides or ends of the valve member 64–70 therein, of approximately 26 psi. This hydraulic pressure differential in the hydraulic fluid control valve chamber 48 will be sensed by the hydraulic fluid control valve unit 63–64–70 with the result that the hydraulic fluid pressure in the valve chamber 48 (at the right hand end, as seen in FIGS. 10 and 11) will move the valve member 63–64–70 (right to left, FIGS. 10 and 11) a distance equal to that required for the biasing coil spring 69 on the body 64–70 of the valve member 63–64–70 to maintain the new load required to hold the valve member 64–70 in balance, which, in this example, is a linear distance of approximately 0.050 inch.

This movement of the hydraulic fluid control valve member 63–64–70 in the valve chamber 48, from the position in which it is shown in FIG. 10 into the position in which it is shown in FIG. 11, will move the group of four crescent-shaped hydraulic fluid flow control valve ports 49 into communication with the annular channel section 47 of the by-pass flow passage 46, whereupon hydraulic fluid will flow from the annular channel section 47 of the by-pass flow passage 46 into the hydraulic fluid control valve ports 49 and thence into the hydraulic fluid control valve chamber 48 and thence, by way of the port 51, into the regulated flow passage 45. Hence, since there was a 100 psi hydraulic pressure differential from the inlet port 42 to the regulated flow passage 45, oil or like hydraulic fluid will immediately begin to flow, as stated, and the rate of flow thereof will continue to increase until a flow rate is reached which represents a constant flow rate across the exposed areas of the four crescent-shaped valve ports 49 of approximately 100 psi, namely, about 5 gpm, in the present example.

Since, in the present example, the hydraulic pump delivering oil or like hydraulic fluid to the inlet port 42 has been delivering a maximum fluid flow at 100 psi across the valve 35, when delivering a flow of 0.3 gpm through the pilot flow passage 74–75–76, together with a flow of 11.7 gpm through the by-pass flow passage 46, when the additional flow of 5 gpm becomes demanded in and by the regulated flow passage 45, by the movement of the four crescent-shaped valve ports 49 into communication with the annular channel section 47 of the by-pass flow passage 46, the resulting demand of the regulated flow passage 45 becomes satisfied by directing oil or like hydraulic fluid from the by-pass flow passage 46 as follows: The 100 psi in the part or section 60A of the pressure-compensating valve chamber 60-60A, at the left hand end of the pressure-compensating valve member 60-60A, (as seen in FIGS. 10 and 11), falls off or is reduced slightly and this immediately unbalances the pressure-compensating valve member 119–124 in the part or section 60A of the pressure-compensating valve chamber 60-60A, which causes a movement of the pressure-compensating valve member 119–124 and the annular flange or valve head 130 thereon, under the force of the spring 126 (right to left, FIGS. 10 and 11), toward or into engagement with the valve seat 246, in an effort to re-establish the 100 psi hydraulic pressure in the part or section 60A of the pressure-compensating valve chamber 60-60A (at the left hand end of the pressure-compensating valve chamber 60-60A, as seen in FIGS. 10 and 11), and thus reduces the flow of oil or like hydraulic fluid from the by-pass flow passage 46 through the part or section 60A of the pressure-compensating valve chamber 60-60A into the by-pass flow passage outlet port 44.

This action of the new proportional flow control valve 35 becomes complete, as in the present example, when the pressure compensating valve member 119–124 has again stabilized the 100 psi pressure differential in both parts or sections 60 and 60A of the pressure-compensating valve chamber 60-60A, at both sides or ends of the valve member 119–124 therein, after a sufficient volume of oil or like hydraulic fluid (5 gpm in the present example) has been routed from the annular channel section 47 of the by-pass flow passage 46 into the crescent-shaped valve ports 49 and into the hydraulic fluid control valve member 48, to establish the 100 psi across the valve ports 49.

Hence, the final flow rate in the present example will be approximately 5.3 gpm out of the regulated flow passage outlet port 43 and approximately 6.7 gpm out of the by-pass flow passage outlet port 44.

In the typical example set forth above, the biasing spring 69 on the hydraulic fluid flow control valve member 64–70 is designed to permit the valve member 64–70 to move through its entire permissible stroke in the valve chamber 48, namely, through a linear distance of 0.100 inch, over a 50 psi pressure differential in the hydraulic fluid control valve chamber 48, at opposite ends of the valve member 64–70 therein.

In the preferred embodiment of the invention illustrated in the drawings, and as set forth in the foregoing example, typical characteristics and dimensions of certain of the significant parts of the invention are as follows:

TYPICAL CHARACTERISTICS AND DIMENSIONS OF CERTAIN PARTS OF THE VALVE 35 AND OF THE OPERATING SOLENOID 108-117 AND OF THE ENERGIZING CIRCUIT 175

1. The variable resistor or potentiometer 174–173 is of conventional design and construction and a suitable unit for use in the practice of the present invention; is a variable resistor manufactured by CTS of Berne, Inc., 406 Parr Road, Berne, Indiana 46711;

2. A typical current range for the solenoid coil 117 for the operating solenoid 108 for the movable pilot valve member 84, as in the foregoing example, is from 150 to 300 milliamperes;

3. The solenoid 108 is approximately 2.5 inches in length and 1.25 inches in diameter and the force of the solenoid 108–117 on the movable pilot valve member 84, over the current range set forth in (2) above, is from 0.37 to 1.9 pounds;

4. A typical stroke of the movable pilot valve member 84 from its deenergized position, as in FIG. 10, into its energized position as in FIG. 11, in engagement with the pilot valve seat 82, is 0.020 inch;

5. The diameter of the orifice 249 in the central passage or bore 80 in the portion 189 of the branch 75 of the pilot flow passage 74 is 0.031 inch, and the diameter of the orifice 250 in the portion 96 of the branch 76 of the pilot flow passage 74 is also 0.031 inch;

6. The diameter of the pilot valve seat 82 is 0.156 inch;

7. The lap of the hydraulic fluid control valve member 64–70 in the hydraulic fluid control valve chamber 48 is 0.010 inch when the solenoid 108–117 is deenergized;

8. The bore diameter of the hydraulic fluid pressure compensating valve chamber 60-60A is 0.875 inch;

9. The rated spring force of the biasing spring 69 on the hydraulic fluid control valve member 64–70 is 3.0 lb., as installed, with a 123.5 lb. per inch spring rate;

10(a) Typical dimensions of the crescent-shaped hydraulic fluid control valve ports 49 in the valve body 64 are as follows:

(1) diameter (circumferentially) — 0.625 inch
(2) length (front to rear) — 0.090; and
(3) depth — $\frac{1}{8}$ inch (b) The lap of the crescent-shaped hydraulic fluid control valve ports 49 in the valve body 64, relative to the annular channel section 47 of the by-pass flow passage 46, is 0.010 inch;

11. The force of the coil springs 126 and 123 on the pressure compensating valve member 119–124, in the pressure compensating valve chamber 60-60A, is 60.2 lbs.;

12. The linear stroke of the pressure compensating valve member 119–124 in the pressure compensating valve chamber 60-60A is 0.220 inch with a lap at each end of 0.020 inch;

13. The overall dimensions of the valve body 36 of the new proportional flow control valve 35, as described in the foregoing example, and in a relatively smaller form of the new valve 35, are as follows:

(a) Heighth 4 inches;
(b) Width 1¼ inches;
(c) Length 3½ inches;

14. The rated capacity of the smaller form of the new valve 35, as set forth in the foregoing example, is from 0.3 to 15 gpm;

15. In a larger size of the new valve 35, having a rated capacity of from 0.3 to 30 gpm, the overall dimensions of the valve body 35 are as follows:

(a) Heighth 5 inches;
(b) Width 1¾ inches;
(c) Length 4½ inches; and

16. The microswitches 171–170 are of conventional design and construction and a typical microswitch for use in the practice of the present invention is one manufactured by the Microswitch Company of Freeport, Illinois, and identified as its Model V-3L129.

CERTAIN ADDITIONAL FUNCTIONAL AND STRUCTURAL CHARACTERISTICS AND ADVANTAGES OF THE INVENTION

1. The new valve 35 may be used as a three-port flow control regulator or as a two-port type pressure compensating flow regulator valve by closing or plugging the by-pass port 44, as illustrated in FIG. 27;

2. The reverse flow check valve unit 135 simplifies the plumbing connections when the new valve 35 is used in so-called meter-in and meter-out applications of hydraulic systems;

3. The two and three port pressure compensation feature of the new proportional flow control valve 35 enables it to be used in conventional open, tandem and closed center hydraulic circuits in which meter-in or meter-out and bleed off flows are readily accomplished;

4. The manually operable control lever 153–154 may be banked or stacked to duplicate lever motion of standard manual directional control valves and the manually operable control lever 153–154 is normally latched or detented in its normal or neutral position in order to prevent inadvertent movement of the control lever 153–154. The manually operable remote control device 146 has a simple, rugged built-in voltage regulator circuit to assure precise adjustment and repetition even though the input supply voltage thereto might vary from 10 VDC to 15 VDC;

5. A manual override adjusting screw (not shown) may be provided on the new valve 35 as a standard feature in order to establish flow in the event of electrical power loss to the operating solenoid 108–117 for the movable pilot valve member 84;

6. The new proportional flow control valve 35 is basically a three-port flow regulator in which the hydraulic fluid enters the inlet port 42 and is directed through the hydraulic flow control valve unit 63-64-70 and thence through the other parts of the regulated flow passage 45 with any excess inlet flow over the amount which flows through the regulated flow passage 45 being automatically directed to and through the by-pass flow passage 46 and the by-pass outlet port 44;

7. As hereinbefore described, the flow rate through the regulated flow passage 45 and out of the regulated flow passage outlet port 43 is determined by the voltage of the electrical current applied to the solenoid coil 117 for the operating solenoid 108 for the movable pilot valve member 84. Thus, with current levels under 0.150 amps (2.5 VDC) the regulated flow through the regulated flow passage 45 may be 0.3 gpm. As the angular displacement of the manually operable control lever 153–154 is increased the current applied to the energizing circuit 175 and the solenoid coil 117 for the operating solenoid 108 for the movable pilot valve member 84 increases, in a direct linear relationship, to 0.30 amps (5.0 VDC) which results in a correspondingly uniform increase in the regulated fluid flow rate through the regulated flow passage 45 and regulated flow outlet port 43 since the group of four crescent-shaped hydraulic fluid control ports 49 are moved into communication with the annular channel section 47 of the by-pass flow passage 46 in a direct relationship to the voltage of the electrical current imparted by the manually operable remote control device 147-153-154 and the potentiometer 173–174 to the energizing circuit 175 and to the solenoid coil 117 for the operating solenoid 108 for the movable pilot valve member 84;

8. Since the new proportional flow control hydraulic valve 35 is pressure compensated, the flow rate through the regulated flow outlet port 43 remains constant, once the manually operable remote control lever 153-154 has been adjusted to the desired portion, regardless of the volume of fluid flow into the inlet port 42 or the hydraulic load pressure in the hydraulic system in which the new valve 35 may be used, and any excess fluid flow is directed through the by-pass flow passage 46 and the by-pass outlet port 44 and may be piped back to a hydraulic fluid reservoir for further use or otherwise used in the hydraulic system in which the new valve 35 may be used;

9. The minimum operating hydraulic pressure for the new valve 35, in the smaller form thereof, having the dimensional characteristics set forth in the foregoing example, is 100 psi, and the maximum operating pressure is 3000 psi with a flow rate of from 0.3 to 15 gpm, with an optional flow rate of from 0.3 to 6.0 gpm, whereas a larger form of the new valve 35, as hereinbefore described, has a regulated flow rate from 0.3 gpm to 30 gpm;

10. As pointed out hereinbefore, should the hydraulic pump input flow to the inlet port 42 increase, the new valve 35 automatically directs the excess oil or other hydraulic fluid to the by-pass flow passage 46 and thence out of the by-pass outlet port 44 but the 0.3 gpm flow through the hydraulic fluid control chamber 48 remains constant when the solenoid 108 is deenergized;

11. It is to be noted that the pressure compensating valve unit 54 automatically responds to any variation in pressure or flow rate through the regulated flow passage 45, or through the by-pass flow passage 46, and thus maintains the necessary 100 psi pressure differential across the crescent-shaped hydraulic fluid flow control ports 49 in the hydraulic fluid control valve chamber 48. The rated flow is obtained by machining the crescent-shaped fluid control valve ports 49 to the desired size, shape and dimensions and providing the necessary characteristics in the biasing spring 69 on the hydraulic fluid pressure control valve member 64–70, and the constant 100 psi pressure differential across the hydraulic flow control valve unit 64–70 is maintained by automatically opening or closing the by-pass flow passage 46, as explained hereinbefore; and 12. The new proportional flow control valve 35 embodies the reverse flow check valve unit 135 for the reason that there are applications in which the new valve 35 may be subjected to reverse flow conditions and it is desired to maintain a low hydraulic pressure drop in the reverse flow of the hydraulic fluid through the valve 35 from the regulated flow outlet port 43 and the regulated flow passage 45 to the inlet port 42, as illustrated diagrammatically in FIG. 26 and as further illustrated in FIG. 27.

It will be noted that the movable pilot valve member 84 can be moved into an infinite number of positions in the first branch 75 of the pilot flow passage 74 by the solenoid 108-117 and that in each of such positions the movable pilot valve member 84 will permit a corresponding but different volume of hydraulic fluid to flow through the first branch 75 of the pilot flow passage 74 into the hydraulic fluid control valve chamber 48 and a corresponding proportional part of the body or volume of hydraulic fluid to be diverted from the annular channel section 47 of the by-pass flow passage 46 through the valve ports 49 into the hydraulic fluid control valve chamber 48 and thence into the regulated flow passage 45.

TYPICAL USES OF THE INVENTION AS ILLUSTRATED IN FIGS. 26 TO 33, INCLUSIVE

THE USE OF THE INVENTION ILLUSTRATED IN FIG. 27

Certain typical uses of the new valve 35 in various types of hydraulic circuits and for various applications and purposes are illustrated in FIGS. 26 to 33, inclusive, and these will now be described.

FIG. 27 illustrates the use of the new proportional flow control valve 35 used as a free reverse flow valve with the valve head 137 of the check valve 135 disposed out of engagement with the check valve seat 138, rather than in engagement with the check valve seat 138, as in FIGS. 10 and 11.

Thus, when the new valve 35 is so used, as a free reverse flow valve, as in FIG. 27, the fluid flow is through the regulated outlet port 43 along the path of the arrows as shown in FIG. 26, through the port 55, through the part 60 of the pressure-compensating valve chamber 60-60A, through the inclined passage 53, past the check valve seat 138, through the check valve chamber 58, through the annular channel section 57-47 of the by-pass flow passage 46, and thence into and out of the inlet port 42 into the hydraulic system in which the new proportional flow control valve 35 may be so used, as in certain of the typical uses thereof illustrated in FIGS. 28 to 33, inclusive.

It will be noted that in the use of the new proportional flow control valve 35 as a reverse flow valve, as in FIGS. 26 and 27, when the hydraulic fluid flows through the inclined portion 53 of the regulated flow passage 45 it engages the head 137 of the check valve 135 and urges the check valve 135-136-137, against the action of the spring 143, and moves the check valve head 137 out of engagement with the valve seat 138 so that the hydraulic fluid in its reverse flow will flow into and through the annular section 57-47 of the by-pass flow passage and thence into and out of the inlet port 42.

THE USE OF THE INVENTION AS ILLUSTRATED IN FIG. 28

In the use of the invention as illustrated in FIG. 28 those parts of the invention which are similar to or correspond to parts of the invention illustrated in FIGS. 1 to 25, inclusive, of the drawings, have been given the same reference numerals followed by the additional reference character "*a*".

The use of the form of the invention as illustrated in FIG. 28 involves a modification of the use of the energizing circuit 175 illustrated in FIG. 12 and illustrates the manually operable remote control device **147*a* and the energizing circuit 175*a* for the coil 117*a* of the operating solenoid 108*a* for the movable pilot valve member 84 of FIGS. 10 and 11 but also illustrates the use of a directional hydraulic fluid flow control device, which is generally indicated at 192, and which is of conventional design, incorporated in the energizing circuit 175*a* under the control of the manually operable remote control device 146*a***.

As shown in FIG. 28, the directional flow control device 192 includes a solenoid control device 193 for a directional flow control valve (not shown) and the solenoid control device 193 includes a pair of solenoid coils 194 and 195 which are incorporated in the energizing circuit **175*a* for the operating solenoid 108*a*-117*a* for the movable pilot valve member 84, as shown in FIGS. 10 and 11, under control of the manually operable remote control device 146*a*-153*a*-154*a* and the voltage varying potentiometer 174*a*-252*a***.

Thus, as shown in FIG. 28, a conductor line 196 leads from the stationary switch contact member **184*a* of the movable arm 170*a* of one of the microswitch units 170*a*-171*a* to one side of the solenoid coil 194; a conductor line 197 leads from a contact 198 at the other side of the solenoid coil 194 to one side of the resistor 261*a*; and a conductor line 199 leads from the stationary contact member 182*a* of the other microswitch unit 170*a*-171*a* to the other coil 195 of the solenoid device 192**.

In the use of the invention, as illustrated in FIG. 28, when the manually operable remote control lever **153*a*-154*a* of the manually operable remote control device 146*a* is operated in one direction to close one of the microswitch units 170*a*-171*a* and thereby energize the energizing circuit 175*a* for the operating solenoid 108*a*-117*a* for the movable pilot valve member 84 (FIGS. 10 and 11), one of the solenoid coils 194 or 195 is energized to operate the directional flow control valve controlled thereby in one direction, whereas when the manually operable remote control lever 153*a*-154*a* is moved in the opposite direction to close the other microswitch unit 170*a*-171*a* and energize the energizing circuit 175*a* for the operating solenoid 108*a*-117*a* for the movable pilot valve member 84 (FIGS. 10 and 11) the other one of the solenoid coils 194 or 195 is energized to operate the directional flow control valve in the opposite direction, and thus control the direction of fluid flow in the hydraulic circuit in which the new proportional flow control valve 35** is incorporated in such usage.

Thus, the use of the invention as illustrated in FIG. 28 enables the new proportional flow control valve 35 and the manually operable remote control device **146*a* therefor, and the solenoid energizing circuit 175*a* under control thereof, to be used for controlling the solenoid operating device for a directional flow control device which may be embodied in a hydraulic circuit in which the new proportional flow control hydraulic valve 35** is thus used.

THE USE OF THE INVENTION AS ILLUSTRATED IN FIG. 29

Another typical use of the new proportional flow control hydraulic valve 35 is illustrated in FIG. 29 in which those parts which are similar to or correspond to parts of the invention illustrated in FIGS. 1 to 25, inclusive, and as hereinbefore described, have been given the same reference numerals followed by the additional and distinguishing reference character "*b*".

In the use of the new proportional flow control hydraulic valve **35*b*, as illustrated in FIG. 29, the proportional flow control valve 35*b* is interposed between a four-way directional flow control valve 201 and solenoid devices 192*b* which operate the four-way directional flow control valve 201, and the solenoid devices 192*b* are under control of an energizing circuit 200. The arrangement shown in FIG. 29 shows the use of the new proportional flow regulator valve 35*b* in connection with a hydraulic piston-cylinder device or hydraulic ram 204 which includes a cylinder 264 and a piston 265** movable therein.

Depending upon which one of the operating solenoids **192*b* for the four-way directional flow control valve 201 is energized, the regulated flow from the new proportional flow control hydraulic valve 35*b* may be directed into the cylinder 264, at either side of the piston 265, by way of one of a pair of hydraulic lines 203 and 205**.

In the use of the invention, as illustrated in FIG. 29, a hydraulic pump is indicated at 206, a pair of fluid reservoirs are indicated at 207 and 208, and a relief valve is indicated at 209.

The use of the new proportional flow control hydraulic valve unit **35*b*, as illustrated in FIG. 29, is such that when the manually operable control lever 153*b*-154*b* of the manually operable remote control device 146*b*-153*b*-154*b* is operated in one direction to energize the energizing circuit 175*b* for the operating solenoid 108*b* for the movable pilot valve member 84 (FIGS. 10 and 11) the energizing circuit 175*b* will energize the operating solenoid 192*b* for one side of the directional flow control valve 201 and hydraulic fluid from the new proportional flow control hydraulic valve 35*b* will flow through one of the hydraulic lines 203 or 205 into the cylinder 264 at one side of the piston 265 of the piston-cylinder unit or hydraulic ram 204. Similarly, when the manually operable remote control lever 153*b*-154*b* is moved in the opposite direction to energize the operating solenoid 108*b* for the movable pilot valve member 84 (FIGS. 10 and 11) the operating solenoid 192*b* for the other directional control valve 202 will be energized and hydraulic fluid from the proportional flow control hydraulic valve 35*b* will then flow through the other one of the hydraulic lines 203 and 205 into the cylinder 264 of the piston-cylinder unit or hydraulic ram 204 at the opposite side of the piston 265**.

THE USE OF THE INVENTION ILLUSTRATED IN FIG. 30

Another typical use of the invention is illustrated in FIG. 30 of the drawings and those parts thereof which are similar to or correspond to parts of the invention illustrated in FIGS. 1 to 25, inclusive, have been given the same reference numerals followed by the additional and distinguishing reference character "*c*".

In the use of the invention as illustrated in FIG. 30, the operating solenoid **108*c* for the movable pilot valve member 84 (FIGS. 10 and 11) is incorporated in an energizing circuit 175*c* which includes the manually operable remote control device 146*c* and the manually operable remote control lever 153*c*-154*c* embodied therein. In this use of the invention, as illustrated in FIG. 30, the new proportional flow control valve 35*c* is incorporated in a hydraulic circuit 210 which includes a pressure compensated variable flow hydraulic pump 211, and a hydraulic line 212 leads from the hydraulic pump 211 into the new proportional flow control valve 35*c* and thence out of the same by way of the regulated flow passage 45*c*. A by-pass flow passage 46*c* leads out of the new proportional flow control hydraulic valve 35*c* and a hydraulic line 213 leads from the by-pass flow passage 46*c* to the pressure compensator of the pressure compensated variable flow hydraulic pump 211**.

THE USE OF THE INVENTION ILLUSTRATED IN FIG. 31

FIG. 31 illustrates another typical use of the new proportional flow control hydraulic valve of the present invention and the remote control device therefor, and those parts shown in FIG. 31 which are similar to or correspond to parts illustrated in FIGS. 1 to 25, inclusive, have been given the same reference numerals followed by the additional and distinguishing reference character "*d*".

In the use of the new proportional flow control hydraulic valve **35*d* as shown in FIG. 31, a pair of the new proportional flow control valves are indicated at 35*d* and the operating solenoids 108*d* therefor are incorporated in an energizing circuit 175*d* which includes the manually operable remote control device 146*d*-153*d*-154*d*. The regulated flow passages 45*d* from the proportional flow control valves 35*d* lead by way of hydraulic lines 214 and 215 to so-called meter-in directional flow control valves 216 and 217, respectively, which are connected by hydraulic lines 218 and 219, respectively, to the cylinder 221 of a hydraulic piston-cylinder device or hydraulic ram 220 on opposite sides of a piston 222 in the cylinder 221**.

The operating solenoid 223 for the directional flow control valve 216 is connected by conductor lines 224 and 225 into the energizing circuit **175*d*, under control of the remote control device 146*d*, and the operating solenoid 226 for the directional flow control device 216 is connected by conductor lines 227 and 228 into the energizing circuit 175*d***.

A hydraulic fluid inlet line 229 leads from the hydraulic circuit in which the arrangement shown in FIG. 31 is used into the inlet port **42*d* of one of the proportional flow control valves 35*d* and a hydraulic fluid outlet line 230 leads from the regulated flow outlet port 43*d* of the other proportional flow control valve 35*d* back into the hydraulic system in which the arrangement shown in FIG. 31** is used.

In the use of the invention, as illustrated in FIG. 31, when the manually operable remote control lever **153*d*-154*d* is operated in one direction to energize the energizing circuit 175*d* the operating solenoid 108*d* for one of the proportional flow control valves 35*d* is energized and hydraulic fluid from the hydraulic inlet line 229 will flow through one of the proportional flow control valves 35***d* and out of the regulated flow passage 45*d* thereof through the hydraulic line 215 to one of the solenoid operated directional flow control devices 217, the operating solenoid 226 for which is at the same time energized. The hydraulic fluid will then flow through the hydraulic line 219 into the cylinder 221 at one side of the piston 222 to move the piston 222 therein in one direction under a regulated hydraulic fluid flow force.

However, when the manually operable remote control lever 153*d*-154*d* is operated in the opposite direction and the energizing circuit 175*d* is thus energized it will energize the operating solenoid 108*d* for the other proportional flow control valve 35*d*, whereupon the hydraulic fluid from the second proportional flow valve 35*d* will flow out of the regulated flow outlet passage 45*d* thereof through the hydraulic line 214 and the directional flow control device 216 and the hydraulic line 218 into the cylinder 221 at the opposite side of the piston 222 to move the piston 222 in the opposite direction in the cylinder 211 under a regulated hydraulic fluid flow force.

THE USE OF THE INVENTION ILLUSTRATED IN FIG. 32

FIG. 32 illustrates another typical use of the present invention, and those parts of the invention which are illustrated in FIG. 32 which are similar to or correspond to parts of the invention illustrated in FIGS. 1 to 25, inclusive, have been given the same reference numerals followed by the additional and distinguishing reference character "*e*".

FIG. 32 illustrates the use of a pair of the new proportional flow control hydraulic valves 35*e* for controlling a hydraulically operated auger conveyor 231 which is arranged in a hydraulic circuit 232, and a hydraulically operated spinner 233 as used in automotive vehicle trucks for spreading sand, salt or fertilizer on highways, streets and the like. The hydraulic circuit 232 includes a fluid reservoir 234 for the hydraulically operated auger conveyor 231 and a fluid reservoir 235 for the hydraulically operated spinner 233. A hydraulic pump 236 is incorporated in the hydraulic circuit 232 and is connected to a fluid reservoir 237. A hydraulic line 238 leads from the regulated flow outlet port (not shown) of one of the proportional flow control valves 35*e* to the hydraulically operated auger conveyor 231 and a hydraulic line 239 leads from the regulated flow outlet port (not shown) of the other proportional flow control valve 35*e* to the hydraulically operated spinner 233.

In the use of the invention illustrated in FIG. 32, when the energizing circuit 175*e* and the operating solenoid 108*e* for one of the proportional flow control valves 35*e* are energized, the operating solenoid 108*e* thus energized will actuate the hydraulically operated auger conveyor 231, whereas when the operating solenoid 108*e* for the other proportional flow control valve 35*e* is energized it will actuate the hydraulically operated spinner 233.

THE USE OF THE INVENTION ILLUSTRATED IN FIG. 33

FIG. 33 illustrates another typical use of the new proportional flow control hydraulic valve 35 of the present invention and those parts illustrated in this figure which are similar to or correspond to comparable parts of the invention illustrated in FIGS. 1 to 25, inclusive, have been given the same reference numerals followed by the additional and distinguishing reference character "*f*".

In the use of the new proportional flow control valve 35*f*, as illustrated in FIG. 33, a normally closed two-position solenoid-operated valve 240 is incorporated in a hydraulic circuit 241 which includes a hydraulic fluid reservoir 242, a piston-cylinder unit or hydraulic ram 243, which includes a piston 270 and a cylinder 271, a hydraulic pump 244, a hydraulic reservoir 245 for the hydraulic pump 244, a pressure-compensated two port flow regulator 268 of, for example, 0.4 gpm capacity, and a check valve 269.

In the use of the new proportional flow control valve 35*f*, as shown in FIG. 33, when the operating solenoid 108*f* for the new proportional flow control valve 35*f* is energized, it will act on the new proportional flow control valve 35*f* controlled thereby and thereby cause the flow of hydraulic fluid from the valve 35*f* through the hydraulic line 241 to control the speed of rising movement of the piston 270 in the cylinder 271 in accordance with the current supplied by the solenoid 108*f* to the proportional flow control valve 35*f* whereas energization of the normally closed solenoid-operated valve 240, independently of the energization of the new proportional flow control valve 35*f*, by means of the solenoid 108*f*, will open the valve 240 to control the speed of lowering of the piston 270 in the cylinder 271.

THE USE OF THE INVENTION AS A TWO PORT FLOW REGULATOR VALVE

The new proportional flow control valve 35 may also be used as a two-port flow regulator by inserting an externally threaded closure member or plug (not shown) into the internally threaded by-pass flow outlet port 44 (FIGS. 10 and 11), and when so used, and the 100psi pressure differential in the pressure-compensating valve chamber 60-60A is unbalanced, the pressure-compensating valve member 119–124 will move (left to right, FIG. 10) to engage the annular flange or valve head 129 thereon against the valve seat 248 in order to establish the 100 psi in the part or section 60A of the pressure-compensating valve chamber 60-60A and against the pressure-compensating valve member 119–124.

THE MODIFICATION SHOWN IN FIGS. 34 TO 39, INCLUSIVE

A modification of the invention is illustrated in FIGS. 34 to 39, inclusive, of the drawings, and those parts thereof which are similar to or correspond to parts in the preferred form of the invention illustrated in FIGS. 1 to 25, inclusive, have been given the same reference numerals followed by the additional and distinguishing reference character "*g*".

In the modification of the invention illustrated in FIGS. 34–39 the hydraulic fluid control valve 63*g*-64*g* differs from the hydraulic fluid control valve 63–64 which is embodied in the form of the invention shown particularly in FIGS. 10, 11, 15, 16 and 19 in that in the valve member 63*g*-64*g* the fluid control valve ports 49*g* in the valve member 63*g*-64*g* differ in shape, size and form from the crescent-shaped valve ports 49 in the valve member 63–64 and, as shown particularly in FIG. 36, the valve ports 49*g* are elongated but are not crescent-shaped (compare FIGS. 36 and 19).

In the form of the invention illustrated in FIGS. 34 to 39, inclusive, the new proportional flow control hydraulic valve 35*g* is generally similar in construction to the form of the proportional flow control hydraulic valve 35 shown particularly, in FIGS. 10, 11 and 19, but differs therefrom in that in the modification of the invention shown in FIGS. 34 to 39, inclusive, the parts are so designed and constructed that when the manually operable remote control lever 153–154 is in its neutral, latched and centered position, as in full lines in FIGS. 5 and 6 and as in FIG. 7, and the energizing circuit 175 (FIG. 12) and the solenoid 108g-117g (FIG. 34) are deenergized and the movable parts of the new proportional flow control hydraulic valve 35g are disposed as in FIG. 34, the valve ports 49g in the hydraulic fluid control valve member 63g-64g are disposed in communication with the annular channel section 47g of the by-pass flow passage 46g so that the annular end wall 266 on the valve member 63g-64g is disposed out of engagement with a valve seat 267 which is formed in the body 36g of the valve 35g at one side of the annular channel 47g of the by-pass flow passage 46g (FIGS. 34 and 35). When the parts are so disposed, as in FIG. 34, the main body or volume of oil or like hydraulic fluid from the inlet port 42g will flow through the hydraulic fluid control valve ports 49g in the hydraulic fluid control valve member 63g-64g (FIG. 36) into the hydraulic fluid control valve chamber 48g and thence around the filter 73g and the port 51g, through the inclined section 53g of the regulated flow passage 45g, and thence into and through the part or section 60g of the pressure compensating valve chamber 60g-60Ag and past the valve seat 248g and through the port 55g into the regulated flow passage 45g to the regulated flow outlet 43g. Thus, when the parts are disposed as in FIG. 34, only part of the hydraulic fluid from the inlet port 42g will flow through the annular channel section 47g of the by-pass flow passage 46g and thence through the inclined section 54g of the by-pass flow passage 46g, through the section 60Ag of the pressure compensating valve chamber 60Ag-60g past the valve seat 246g into the by-pass flow outlet port 44g.

However, when it is desired to divert a proportional part of the body of oil or hydraulic fluid which flows from the inlet port 42g into the regulated flow passage 45g into the by-pass flow passage 46g, this is accomplished by operation of the manually operable control lever 153–154 to close one of the microswitches 170–171 and thereby close and energize the energizing circuit 175 and the potentiometer 174–252 (FIG. 12) to energize the operating solenoid 108g-117g and thereby move the movable pilot valve member 84g toward or into engagement with the pilot valve seat 82g and thus reduce the volume of fluid flow through the pilot valve chamber 80g and past the pilot valve member 84g and thence through the chamber 90g and port 91g into the central bore or passage 67g in the movable pilot valve member 64g and into the hydraulic fluid control chamber 48g. This action unbalances the hydraulic pressure equilibrium in the hydraulic fluid control valve chamber 48g, at opposite ends of the hydraulic fluid control valve member 63g-64g thereon, and reduces the hydraulic pressure in the left hand portion of the hydraulic fluid control valve chamber 48g, thereby enabling the hydraulic fluid pressure in the right hand end portion of the hydraulic fluid control valve chamber 48g to overcome the force of the biasing spring 69g and thereby move the hydraulic fluid control valve member 63g-64g in the hydraulic fluid control valve chamber 48g (right to left, as seen in FIG. 34) from the position in which it is shown in FIG. 34 into the position in which it is shown in FIG. 35.

This movement of the hydraulic fluid control valve member 63g-64g in the hydraulic fluid control valve chamber 48g, from the position in which it is shown in FIG. 34 into the position in which it is shown in FIG. 35, causes the annular valve head 266 on the body of the hydraulic fluid control valve member 63g-64g (FIGS. 34, 35 and 36 to 39, inclusive) to move (right to left, FIG. 34) into engagement with the valve seat 267, thereby shutting off the flow of hydraulic fluid from the annular channel section 47g of the by-pass flow passage 46g through the hydraulic fluid control ports 47g into the hydraulic fluid control valve chamber 48g, and thence around the filter 73g and port 51g into the regulated flow passage 45g; it being noted, in this connection, that when the annular valve head 266 on the body of the hydraulic fluid control valve member 63g-64g is in this position and seated against the valve seat 267 (as in FIG. 35), it closes the outer end portions of the valve ports 49g (right hand end portions as seen in FIGS. 34, 35 and 36) and prevents fluid flow therethrough into the hydraulic fluid control valve chamber 48g.

At the same time, the aforesaid movement of the hydraulic fluid control valve member 64g and the hydraulic fluid control valve ports 49g therein from the position in which they are shown in FIG. 34 into the position in which they are shown in FIG. 35, causes a corresponding and proportional increase in the flow of the oil or like hydraulic fluid from the inlet port 42g through the annular channel section 47g of the by-pass flow passage 46g, around the hydraulic flow control valve chamber 48g into the by-pass flow passage 46g and thence toward and into the by-pass outlet port 44g.

It will be noted by a comparison of the hydraulic fluid control valve ports 49 in the hydraulic fluid control valve member 64 with the hydraulic fluid control valve ports 49g in the hydraulic fluid control valve member 64g (compare FIGS. 10, 11 and 19 with FIGS. 34, 35 and 36), that the hydraulic fluid control valve ports 49 are crescent-shaped in plan form and open outwardly onto the end wall 216 of the body of the hydraulic fluid control valve member 64 (see FIG. 19) whereas the hydraulic fluid control valve ports 49g in the hydraulic fluid control valve member 63g-64g in the modification illustrated in FIGS. 34, 35 and 36, are elongated in plan form and the outer end portions thereof are closed by the annular wall or valve head 266 on the body of the hydraulic fluid control valve member 63g-64g at one end thereof (FIGS. 34 and 39, inclusive). This difference in the form of the valve ports 49g and the annular wall or valve head 266 on the body of the hydraulic fluid control valve member 63g-64g enables the valve ports 49g to be positioned, as in FIG. 34, in communication with both the hydraulic fluid control valve chamber 48g, and with the annular channel section 47g of the by-pass flow passage 46g, and to be positioned, as in FIG. 35, with the valve ports 49g completely cutting off fluid flow from the annular channel section 47g of the by-pass flow passage 46g into the hydraulic fluid control valve chamber 48g.

It will thus be seen from the foregoing description, considered in conjunction with the accompanying drawings, that the present invention provides a new and improved proportional flow control hydraulic valve, and a novel combination therewith of a solenoid operating means, an energizing circuit for the solenoid operating means, and a novel manually operable remote control device therefor, having the desirable advantages and characteristics and accomplishing their intended objects including those hereinbefore set forth and others which are inherent in the invention.

We claim:

1. A proportional flow control hydraulic valve device comprising, in combination:

(a) a valve body having therein
  (1) an inlet port for hydraulic fluid;
  (2) a regulated flow outlet port; and
  (3) a by-pass outlet port;

(b) a regulated flow passage from the inlet port to the regulated flow outlet port;

(c) a by-pass flow passage from the inlet port to the by-pass outlet port and normally conducting the main body or volume of hydraulic fluid from the inlet port to the by-pass outlet port;

(d) a hydraulic fluid flow control valve chamber positioned between the inlet port and the regulated flow outlet port and the by-pass outlet port and having
  (1) opposite open end portions;

(e) a first and hydraulic fluid flow control valve means in the hydraulic fluid control valve chamber between the opposite open end portions thereof;

(f) said by-pass flow passage including a flow channel portion for conducting the hydraulic fluid from the inlet port around the hydraulic fluid control valve chamber into the by-pass flow passage;

(g) biasing means in the hydraulic fluid flow control valve chamber normally biasing the said hydraulic fluid flow control valve means therein into position to prevent flow of hydraulic fluid from the flow channel portion of the by-pass flow passage into the hydraulic fluid control valve chamber and thence into the regulated flow passage, while permitting the main body of hydraulic fluid entering said inlet port to flow through the flow channel portion of the by-pass flow passage around the hydraulic fluid control valve chamber into the by-pass flow passage and to the the by-pass outlet port;

(h) a pilot flow passage including
  (1) a first branch for conducting a relatively small body or volume of hydraulic fluid at a predetermined hydraulic pressure differential from the inlet port into the hydraulic fluid flow control valve chamber through one of the open end portions thereof; and
  (2) a second branch for conducting a relatively small body or volume of hydraulic fluid at the predetermined hydraulic pressure differential from the inlet port into the hydraulic fluid flow control valve chamber through the other one of the opposite open end portions thereof, whereby a balanced hydraulic pressure is maintained in the opposite open end portions of the hydraulic fluid control valve means and against the force of the biasing means, thereby enabling the biasing means to maintain the hydraulic fluid control valve means in position to prevent any portion of the main body or volume of hydraulic fluid from flowing from the flow channel portion of the by-pass flow passage into the hydraulic fluid flow control valve chamber and thence into the regulated flow passage and to the regulated flow outlet port;

(i) second valve means in the first branch of the pilot flow passage for controlling and varying the body or volume of hydraulic fluid flow from the inlet port through the first branch of the pilot flow passage into the hydraulic fluid flow control valve chamber through one of the open end portions thereof and against the hydraulic fluid flow control means, whereby to unbalance the balanced hydraulic pressure in the hydraulic fluid flow control valve chamber at the one open end portion thereof and thereby enable the hydraulic fluid under the predetermined hydraulic pressure in the other open end portion of the hydraulic fluid flow control valve chamber acting against the force of the biasing means to move the hydraulic fluid flow control valve means into a position to establish communication between the flow channel portion of the by-pass flow passage and the hydraulic fluid flow control valve chamber to permit a predetermined portion of the volume or body of a hydraulic fluid flowing through the flow channel portion of the by-pass flow passage to flow into the hydraulic fluid flow control chamber and into the regulated flow passage to the regulated flow passage outlet port in a direct linear relationship to the movement of the second valve means in the first branch of the pilot flow passage;

(j) said second valve means in the first branch of the pilot flow passage including
  (1) a pilot valve chamber;
  (2) a pilot valve seat in the pilot valve chamber; and
  (3) a pilot valve member movably mounted in the pilot valve chamber and normally urged out of engagement with the pilot valve seat by the force of the hydraulic fluid flowing from the inlet port through the first branch of the pilot flow passage but movable toward and into engagement with the pilot valve seat to control and vary the body or volume of hydraulic fluid flowing from the inlet port through the first branch of the pilot flow passage into the hydraulic fluid control valve chamber;

(k) said first and hydraulic fluid flow control valve means in the hydraulic fluid flow control valve chamber including
  (1) a valve member movably mounted in the hydraulic fluid flow control valve chamber;
  (2) the biasing means having the form of a biasing spring acting on the movable valve member to move the movable valve member into position to prevent the flow of hydraulic fluid from the flow channel portion of the by-pass flow passage through the hydraulic fluid flow control valve means into the hydraulic fluid flow control valve chamber and thence to the regulated flow passage and the regulated flow outlet port;

(l) said valve member in the hydraulic fluid flow control valve chamber being generally cylindrical in form and having
  (1) opposite end portions;

(m) said generally cylindrical valve member having
  (1) a first and centrally arranged bore or passage formed therein and extending longitudinally therein from one of the opposite end portions thereof in communication with the first branch of the pilot flow passage;

(n) said generally cylindrical valve member having (1) a second centrally arranged bore or passage formed therein and extending longitudinally therein from the other end portion thereof;

(o) said centrally arranged bores or passages in the generally cylindrical valve member having (1) open inner end portions adjacent each other; and (p) said open inner end portions of the centrally arranged bores or passages in the generally cylindrical valve member having communication with the hydrauic fluid flow control valve chamber and thence with the regulated flow passage.

2. A proportional flow control hydraulic valve device as defined in claim 1 in which (a) the open inner end portions of the centrally arranged bores or passages in the generally cylindrical valve member have (1) orifice outlet members mounted thereon.

3. A flow regulating valve, comprising: a valve body having an inlet port, a regulated flow outlet port, and a bypass flow outlet port; a first valve chamber in the body; an inlet passage extending from the inlet port to the valve chamber; a regulated flow outlet passage extending from the valve chamber to the regulated flow outlet port; a bypass flow outlet passage extending from the valve chamber to the bypass flow outlet port; a flow regulating valve member reciprocable in the valve chamber between first and second positions and having portions thereof arranged to occlude said regulated flow outlet passage in one of said positions of the valve member and to enable and regulate flow from the inlet passage to the regulated flow outlet passage in another of said positions of the valve member; first and second pilot passages extending from the inlet to the valve chamber at opposite ends, respectively, thereof to convey pressure fluid to opposite ends of the valve member, said valve member being hydraulically balanced in one of its first and second positions; a pilot valve member in one of said pilot passages to selectively regulate flow to one of the ends of the flow regulating valve member to cause the flow regulating valve member to be hydraulically unbalanced and to shift from one of its positions to another of its positions; a pressure compensating valve chamber in the body between the first valve chamber and the outlet ports, said regulated flow outlet passage communicating with one end of the pressure compensating valve chamber and the bypass flow outlet passage communicating with the other end of the pressure compensating valve chamber; and a pressure compensating valve in the pressure compensating valve chamber reciprocable in response to the pressures in the respective outlet passages and including valving portions arranged to control flow through the respective outlet passages dependent upon the position of the pressure compensating valve, whereby regulated flow is obtained from the regulated flow outlet port which is directly proportional to positioning of the pilot valve over a wide range of inlet pressures and flow fluctuations.

4. A flow regulating valve as in claim 3, wherein the first valve chamber and flow regulating valve member are cylindrical in configuration and the pressure regulating valve member has an elongate axial bore extending inwardly thereof from each of the opposite ends thereof and has a plurality of hydraulic flow control ports extending outwardly through the pressure regulating valve member from the inner ends of the respective bores, said hydraulic flow control ports being in communication with the regulated flow passage, whereby fluid introduced into the first valve chamber at the opposite ends thereof from the pilot passages is permitted to flow through the flow regulating valve member to the regulated flow passage.

5. A flow regulating valve as in claim 4, wherein each of the pilot passages has a flow restrictor therein for obtaining a reduced pressure in the opposite ends of the first valve chamber relative to the pressure in the inlet passage.

6. A flow regulating valve as in claim 4, wherein the portions of the flow regulating valve member which occlude said regulated flow outlet passage comprises a valve land, and the flow regulating valve member has an annular recess formed therein between the ends thereof and adjacent said valve land, and said ports from the axial bore portions in the flow regulating valve member open into said recess, and a filter screen positioned on the valve member in said recess for filtering fluid flowing from the bore portions and through the ports into the regulated flow passage.

7. A flow regulating valve as in claim 3, wherein the pilot valve member is moved to open position by pressure fluid in the pilot passage from the inlet flow passage and a solenoid and armature are arranged such that energization of the solenoid moves the armature to engage the pilot valve member and move it toward its valve seat to restrict or preclude flow through the said one pilot passage into the associated end of the first valve chamber, the degree of energization of the solenoid determining the amount of closing movement of the pilot valve member against the pressure from the inlet passage.

8. A flow regulating valve as in claim 7, wherein a remotely located potentiometer is connected with the solenoid for varying the amount of energization of the solenoid from a remote location to thereby vary the degree of opening or closing movement of the pilot valve member and thus control the position of the flow regulating valve member, said remote control means comprising a manually operable lever pivotally mounted to a housing and having a cam means carried thereby for operating a microswitch to supply electrical energy to the solenoid, and a potentiometer operated by rotational movement of the lever to vary the amount of energization of the solenoid, said lever normally being biased into a neutral position wherein the switch is disengaged and the pilot valve member is in a fully open position to supply maximum pressure to the associated end of the flow regulating valve member, whereby the flow regulating valve member assumes a position occluding flow from the inlet passage to the regulated flow passage, and latch means operatively engageable with the lever to retain it in its said neutral position.

9. A proportional flow valve, comprising: a valve body having an inlet port, a bypass outlet port, and a regulated flow outlet port therein; a first valve chamber in the valve body; and inlet passage extending from the inlet port to the valve chamber; a bypass flow passage extending from the valve chamber to the bypass flow outlet port; a regulated flow passage extending from the valve chamber to the regulated flow outlet port; a flow regulating valve member movable in the valve chamber and having portions to control flow from the inlet passage to the regulated flow passage; an auxiliary passage from the inlet passage to the bypass passage in bypassing relation to the valve member, whereby flow is enabled from the inlet past the valve member to the bypass passage in all positions of the valve member; a second valve chamber; said outlet passages communicating with the second valve chamber; a pressure compensating valve means movable in the second valve chamber and having portions arranged to control flow through each of the respective outlet passages dependent upon the position of the pressure compensating valve means, said pressure compensating valve means movable to different positions in response to predetermined pressure differences between the outlet passages; and pilot means for positioning said flow regulating valve member to divert more or less flow from the bypass passage to the regulated flow passage, whereby a regulated flow is obtained from the valve over a wide range of inlet pressure and flow fluctuations, said regulated flow being proportional to the position of the regulating valve member, said pilot means including pilot flow passages communicating with different portions of the flow regulating valve member and conveying pressure fluid to said different portions, said regulating valve member being balanced in a neutral position by the pressure fluid acting on said different portions, and a pilot valve means operable to control flow through one of said pilot flow passages to control the pilot pressure acting on said flow regulating valve member to thus cause an unbalance and thereby control the position of the flow regulating valve member, and pilot valve operating means operable from a remote location to operate the pilot valve means.

10. A flow valve as in claim 9, wherein the flow regulating valve member and first valve chamber are cylindrical in shape and the flow regulating valve member has a valve land thereon which cooperates with a port in the side of the valve chamber to control flow through the port into the valve chamber and thence into the regulated flow passage, and said valve land has a plurality of recesses therein for enabling limited flow through the valve port past the valve land and to the regulated flow passage.

11. A valve as in claim 10, wherein the recesses in the valve land of the flow regulating valve member are crescent shaped and are arranged to present a larger flow passage as the valve member is moved to uncover the port from the inlet passage to the regulated flow passage.

12. A valve as in claim 10, wherein the recesses in the valve land of the flow regulating valve member communicate with an annular channel or recessed portion in the valve member and are normally disposed in communication with the inlet passage, said valve land including an end portion which is normally engaged with the interior surface of the valve chamber to preclude flow from the inlet passage into the valve chamber and thence into the regulated flow passage, said crescent shaped notches being disposed such that when the flow regulating valve member is moved to uncover the port from the inlet passage to the valve chamber, an ever increasing flow area through the crescent shaped notches is provided.

13. A valve as in claim 9, wherein a third valve chamber is formed in the valve body between the first valve chamber and the second valve chamber, said third valve chamber having a valve seat between the ends thereof and between the bypass flow outlet passage and regulated flow outlet passage, which passages are in communication with the third valve chamber on opposite sides of the valve seat, and a check valve member reciprocable in the third valve chamber toward and away from the valve seat to prevent flow from the bypass outlet passage into the regulated outlet passage.

14. A valve as in claim 9, wherein the second valve chamber has a pair of valve ports adjacent opposite ends thereof communicating, respectively, with the bypass flow passage and regulated flow passage, and the pressure compensating valve member has a valve land at opposite ends thereof arranged to cooperate with the respective valve ports to divert more flow from one of the passages to its respective outlet port while simultaneously limiting the flow from the other passage to its outlet port.

15. A valve as in claim 14, wherein the pressure compensating valve member is generally cylindrical and has a hollow bore therein extending inwardly from one end thereof over most of the length of the valve member, and yieldable means is in engagement with the pressure compensating valve member normally urging it into a position to close off the port from the bypass flow passage to its associated outlet port.

16. A valve as in claim 9, wherein the valve body is generally rectangular in configuration and has a top wall, a bottom wall, opposite end walls and opposite side walls, said inlet port being in the top wall and said bypass outlet port and regulated flow outlet port being in the bottom wall, said first and second valve chambers being substantially parallel with one another and formed in the valve body between and generally parallel to the top and bottom walls, said inlet passage extending from the inlet port to the first valve chamber approximately intermediate the ends of the first valve chamber and the bypass flow passage and regulated flow passage extending from approximately the middle of the first valve chamber in outwardly divergent directions to opposite ends of the second valve chamber, a third valve chamber formed in the valve body generally parallel to and between the first and second valve chambers and in communication with the bypass flow passage and regulated flow passage and having a valve seat formed therebetween and a check valve member reciprocable in the third valve chamber into and out of engagement with the valve seat to prevent flow from the bypass flow passage into the regulated flow passage and to enable flow from the regulated flow passage to the bypass flow passage when the pressure in the regulated flow passage exceeds a predetermined amount.

17. A valve as in claim 9, wherein the auxiliary passage comprises an annular passage extending around the first valve chamber and normally blocked from communication with the first valve chamber by the flow regulating valve member.

18. A valve as in claim 9, wherein yieldable means is engaged with the flow regulating valve member normally urging it into a position blocking the regulated flow passage from the inlet flow passage.

19. A valve as in claim 9, wherein the flow regulating valve member is reciprocable in the first valve chamber between the neutral position and a position controlling flow to one of the outlet passages.

20. A valve as in claim 19, wherein the pilot flow passages include first and second pilot passages extending from the inlet passage to opposite ends of the first valve chamber to convey pressure fluid to opposite ends of the flow regulating valve member, said flow regulating valve member being balanced in a first position of equilibrium wherein the flow regulating valve member occludes flow from the inlet passage to the regulated flow passage, said pilot valve means including a pilot valve member in one of the pilot passages operable to admit more or less pressure fluid through said one pilot passage to the associated end of the first valve chamber to enable movement of the flow regulating valve member to enable flow from the inlet passage to the regulated flow passage, said pilot valve operating means including solenoid means connected to operate said pilot valve member, and remote control means including means to vary the amount of energization of the solenoid means to thereby vary the amount of opening and closing movement of the pilot valve member and thus vary the amount of movement of the flow regulating valve member.

21. A proportional flow valve, comprising: a valve body having an in inlet port, a bypass outlet port, and a regulated flow outlet port therein; a first valve chamber in the valve body; an inlet passage extending from the inlet port to the valve chamber; a bypass flow passage extending from the valve chamber to the bypass outlet port; a regulated flow passage extending from the valve chamber to the regulated flow outlet port; a flow regulating valve member reciprocable in the valve chamber and having portions to control flow from the inlet passage to the regulated flow passage; an auxiliary passage from the inlet passage to the bypass passage in bypassing relation to the valve member, whereby flow is enabled from the inlet past the valve member to the bypass passage in all positions of the valve member; a second valve chamber in the body; said outlet passages communicating, respectively, with opposite ends of the second valve chamber; a pressure compensating valve member reciprocable in the second valve chamber and having portions arranged to control flow through each of the respective outlet passages dependent upon the position of the pressure compensating valve member, said pressure compensating valve member movable to different positions in response to predetermined pressure differences at opposite ends thereof; means for positioning said flow regulating valve member to divert more or less flow from the bypass passage to the regulated flow passage, whereby a regulated flow is obtained from the valve over a wide range of inlet pressure and flow fluctuations, said regulated flow being proportional to the position of the regulating valve member; said means comprising first and second pilot passages extending from the inlet passage to opposite ends of the first valve chamber to convey pressure fluid to the opposite ends of the first valve chamber; said flow regulating valve member being hydraulically balanced in a first position of equilibrium wherein the flow regulating valve member occludes flow from the inlet passage to the regulated flow passage; a pilot valve member in one of the pilot passages operable to admit more or less pressure fluid through said one pilot passage to the associated end of the first valve chamber to enable movement of the flow regulating valve member to enable flow from the inlet passage to the regulated flow passage; solenoid means connected to operate said pilot valve member; and remote control means including means to vary the amount of energization of the solenoid means to thereby vary the amount of opening or closing movement of the pilot valve member and thus vary the amount of movement of the flow regulating valve member.

22. A proportional flow valve, comprising: a valve body having an inlet port, a bypass outlet port, and a regulated flow outlet port therein; a first valve chamber in the valve body; an inlet passage extending from the inlet port to the valve chamber; a bypass flow passage extending from the valve chamber to the bypass flow outlet port; a regulated flow passage extending from the valve chamber to the regulated flow outlet port; a flow regulating valve member reciprocable in the valve chamber and having portions to control flow from the inlet passage to the regulated flow passage; an auxiliary passage from the inlet passage to the bypass passage in bypassing relation to the valve member, whereby flow is enabled from the inlet past the valve member to the bypass passage in all positions of the valve member; a second valve chamber in the body; said outlet passages communicating, respectively, with opposite ends of the second valve chamber; a pressure compensating valve member reciprocable in the second valve chamber and having portions arranged to control flow through each of the respective outlet passages dependent upon the position of the pressure compensating valve member, said pressure compensating valve member movable to different positions in response to predetermined pressure differences at opposite ends thereof; means for positioning said flow regulating valve member to divert more or less flow from the bypass passage to the regulated flow passage, whereby a regulated flow is obtained from the valve over a wide range of inlet pressure and flow fluctuations, said regulated flow being proportional to the position of the regulating valve member; said second valve chamber having a pair of valve ports adjacent opposite ends thereof communicating, respectively, with the bypass flow passage and regulated flow passage, and the pressure compensating valve member having a valve land at each of the opposite ends thereof arranged to cooperate with the respective valve ports to divert more flow from one of the passages to its respective outlet port while simultaneously limiting the flow from the other passage to its outlet port; said pressure compensating valve member being generally cylindrical and having a hollow bore therein extending inwardly from one end thereof over most of the length of the valve member; yieldable means in engagement with the pressure compensating valve member normally urging it into position to close off the port from the bypass flow passage to its associated outlet port; said yieldable means comprising a double spring arrangement including first and second coil springs arranged coaxially relative to one another and relative to the pressure compensating valve member and engaged on opposite sides of a coupling member; and a pair of elongated rods carried by the coupling member and extending longitudinally of the respective coil springs.

23. A proportional flow valve, comprising: a valve body having an inlet port, a bypass outlet port, and a regulated flow outlet port therein; a first valve chamber in the valve body; an inlet passage extending from the inlet port to the valve chamber; a bypass flow passage extending from the valve chamber to the bypass flow outlet port; a regulated flow passage extending from the valve chamber to the regulated flow outlet port; a flow regulating valve member reciprocable in the valve chamber and having portions to control flow from the inlet passage to the regulated flow passage; an auxiliary passage from the inlet passage to the bypass passage in bypassing relation to the valve member, whereby flow is enabled from the inlet past the valve member to the bypass passage in all positions of the valve member; a second valve chamber in the body; said outlet passages communicating, respectively, with opposite ends of the second valve chamber; a pressure compensating valve member reciprocable in the second valve chamber and having portions arranged to control flow through each of the respective outlet passages dependent upon the position of the pressure compensating valve member, said pressure compensating valve member movable to different positions in response to predetermined pressure differences at opposite ends thereof; means for positioning said flow regulating valve member to divert more or less flow from the bypass passage to the regulated flow passage, whereby a regulated flow is obtained from the valve over a wide range of inlet pressure and flow fluctuations, said regulated flow being proportional to the position of the regulating valve member; said valve body being generally rectangular in configuration and having a top wall, opposite end walls and opposite side walls; said inlet port being in the top wall and said bypass outlet port and regulated flow outlet port being in the bottom wall; said first and second valve chambers being substantially parallel with one another and formed in the valve body between and generally parallel to the top and bottom walls; said inlet passage extending from the inlet port to the first valve chamber approximately intermediate the ends of the first valve chamber and the bypass flow passage and regulated flow passage extending from approximately the middle of the first valve chamber in outwardly divergent directions to opposite ends of the second valve chamber; a third valve chamber formed in the valve body generally parallel to and between the first and second valve chambers and in communication with the bypass flow passage and regulated flow passage and having a valve seat formed therebetween; and a check valve member reciprocable in the third valve chamber into and out of engagement with the valve seat to prevent flow from the bypass flow passage into the regulated flow passage and enable flow from the regulated flow passage to the bypass flow passage when the pressure in the regulated flow passage exceeds a predetermined amount; said first and second pilot passages extending from the inlet passage to opposite ends of the first valve chamber; and restrictor means in each of the pilot passages for reducing the pressure in the opposite ends of the valve chamber acting on the flow regulating valve member.

* * * * *